US009306333B2

(12) United States Patent
Dang

(10) Patent No.: US 9,306,333 B2
(45) **Date of Patent: *Apr. 5, 2016**

(54) HIGH DENSITY SEALED ELECTRICAL CONNECTOR WITH GROUNDING CONTACT FOR IMPROVED MECHANICAL CONNECTION AND SHIELDING

(71) Applicant: Carlisle Interconnect Technologies, Inc., Kent, WA (US)

(72) Inventor: Phong Dang, Auburn, WA (US)

(73) Assignee: Carlisle Interconnect Technologies, Inc., Kent, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/264,650

(22) Filed: Apr. 29, 2014

(65) Prior Publication Data

US 2014/0242840 A1 Aug. 28, 2014

Related U.S. Application Data

(63) Continuation-in-part of application No. 14/064,046, filed on Oct. 25, 2013.

(60) Provisional application No. 61/719,877, filed on Oct. 29, 2012.

(51) Int. Cl.
*H01R 13/6586* (2011.01)
*H01R 13/627* (2006.01)
(Continued)

(52) U.S. Cl.
CPC ..... *H01R 13/6461* (2013.01); *H01R 13/502* (2013.01); *H01R 13/582* (2013.01); *H01R 13/6586* (2013.01); *H01R 13/6277* (2013.01)

(58) Field of Classification Search
CPC ..... H01R 13/6277
USPC ..... 439/607.01–607.05, 607.15, 607.45, 439/607.55, 607.56, 607.08, 607.25, 439/607.27, 357; 174/362
See application file for complete search history.

(56) References Cited

U.S. PATENT DOCUMENTS 3,955,871 A 5/1976 Kruger
4,191,443 A 3/1980 Doyle
(Continued)

FOREIGN PATENT DOCUMENTS

EP 2 355 258 A1 2/2011
FR 2611316 A 8/1988
(Continued)

OTHER PUBLICATIONS

International Electrotechnical Commission, Publicly Available Specification IEC/PAS 61076-2-109 (Pre-Standard), Edition 1.0, dated Mar. 2010, 8 pages.
(Continued)

*Primary Examiner* — Felix O Figueroa
*Assistant Examiner* — Paul Baillargeon
(74) *Attorney, Agent, or Firm* — Stoel Rives LLP

(57) ABSTRACT

An electrical connector system includes mating pin and socket connectors each designed for increased contact density to improve performance of high-speed data transfer. The connectors include features for retaining a plurality of pin or socket contacts in a ganged, co-aligned configuration and for shielding groups of contacts from one another to reduce interference and crosstalk. The connectors further include features for providing strain relief to the internal wires and/or cables. The electrical connectors further include an electrically conductive grounding contact to latch various internal components of the electrical connector together for improved mechanical connection and shielding properties.

14 Claims, 16 Drawing Sheets

(51) Int. Cl.

| | |
|---|---|
| ***H01R 13/6461*** | (2011.01) |
| ***H01R 13/502*** | (2006.01) |
| ***H01R 13/58*** | (2006.01) |

(56) References Cited

U.S. PATENT DOCUMENTS

| | | | | |
|---|---|---|---|---|
| 4,193,655 | A | 3/1980 | Herrmann | |
| 4,261,633 | A | 4/1981 | Abernethy | |
| 5,021,001 | A | 6/1991 | Ramirez | |
| 5,242,316 | A * | 9/1993 | Gartzke et al. | 439/584 |
| 5,797,770 | A | 8/1998 | Davis et al. | |
| 6,077,122 | A | 6/2000 | Elkhatib et al. | |
| 6,190,202 | B1 | 2/2001 | Lai | |
| 6,244,892 | B1 | 6/2001 | McCarthy | |
| 6,264,374 | B1 * | 7/2001 | Selfridge et al. | 385/78 |
| 6,328,601 | B1 | 12/2001 | Yip et al. | |
| 6,494,743 | B1 * | 12/2002 | Lamatsch et al. | 439/607.05 |
| 6,544,067 | B2 | 4/2003 | Hagmann | |
| 6,840,803 | B2 * | 1/2005 | Wlos et al. | 439/585 |
| 6,893,296 | B2 | 5/2005 | Aekins et al. | |
| 7,011,546 | B2 | 3/2006 | Vaccaro | |
| 7,153,168 | B2 | 12/2006 | Caveney et al. | |
| 7,172,466 | B2 | 2/2007 | Aekins et al. | |
| 7,195,518 | B2 | 3/2007 | Bert et al. | |
| 7,255,613 | B2 | 8/2007 | Mackey et al. | |
| 7,316,584 | B2 * | 1/2008 | Mackillop et al. | 439/607.05 |
| 7,736,159 | B1 | 6/2010 | Effinger, III et al. | |
| 8,007,319 | B2 | 8/2011 | Dang | |
| 8,764,471 | B2 * | 7/2014 | Dang | 439/310 |
| 2003/0096529 | A1 | 5/2003 | Brennan et al. | |
| 2004/0157493 | A1 | 8/2004 | Bergner et al. | |
| 2005/0148236 | A1 * | 7/2005 | Montena | 439/578 |
| 2008/0096433 | A1 | 4/2008 | Bixler et al. | |
| 2009/0104819 | A1 | 4/2009 | Hermant et al. | |
| 2010/0048061 | A1 | 2/2010 | Helmig et al. | |
| 2011/0088258 | A1 * | 4/2011 | Gilliam | 29/857 |
| 2012/0171884 | A1 | 7/2012 | Dang | |

FOREIGN PATENT DOCUMENTS

| | | | |
|---|---|---|---|
| FR | 2 805 932 | A1 | 3/2000 |
| WO | WO 2010/115514 | A2 | 10/2010 |

OTHER PUBLICATIONS

Siemon, Network Cabling Solutions, Siemon Z-MAX Category 6A Structured Cabling System, http://www.siemon.com/us/zMAX, visited Dec. 5, 2011, 8 pages.

Siemon, Network Cabling Solutions, Siemon's Z-MAX Structured Cabling Solution: Reinventing the RJ-45 for Tomorrow's Network, Feb. 2009, 12 pages.

Yoshitake, James, Interconnect Solutions for Aircraft Ethernet Data Networks, Defense Electronics Magazine, Oct. 2007, pp. 14-17, Penton Media, Inc.

Phoenix Contact, Assembly Instructions, VS-08-M12MS-10G-P SCO and VS-08-M12MR-10G-P SCO, dated Mar. 2010, 1 page.

Amphenol Aerospace, OCS (Oval Contact System) Connectors, dated Jan. 2013, 7 pages.

* cited by examiner

HIGH DENSITY SEALED ELECTRICAL CONNECTOR WITH GROUNDING CONTACT FOR IMPROVED MECHANICAL CONNECTION AND SHIELDING

RELATED APPLICATION DATA

This application is a continuation-in-part of and claims the benefit under 35 U.S.C. §120 from U.S. patent application Ser. No. 14/064,046, filed Oct. 25, 2013, which is a nonprovisional of and claims the benefit under 35 U.S.C. §119(e) from U.S. Provisional Patent Application No. 61/719,877, filed Oct. 29, 2012, the disclosures of which are each incorporated by reference herein in their entireties.

TECHNICAL FIELD

The field of this disclosure relates to electrical connectors and, in particular, to an electrical connector system with increased contact density and enhanced shielding devices to reduce interference and crosstalk amongst different wires of the cable and different conductors of the connector system.

BACKGROUND

Increasingly, electronic devices transmit and receive high-frequency electrical signals representing digital data. High-speed data transmission, such as so-called Ultra High-Speed (UHS) data transmission involves the transmission of data between electronic devices at rates of 1 to 10 gigabits per second using signal frequencies of 100 MHz to 500 MHz. There is a desire for future high-speed data transmission at even faster rates and at even higher frequencies. For example, UHS data transmission may be achieved over 1000BASE-T Ethernet networks using category 5, 5E, 6 or 6A cables. Such high-speed digital data networks are not confined to terrestrial applications, especially as high-speed electronics are developed for aerospace and other suitable applications.

High-speed digital data transmission is facilitated by a data transmission system with a relatively high signal to noise ratio. For example, one system includes a 1000BASE-T Ethernet network that includes category 5, 5E, 6 or 6A cables. Cables in such a system are designed to propagate data signals without generating or introducing appreciable noise, and are terminated by electrical connectors at either end to either connect cables together, or to connect cables to electronic devices. Electrical connectors commonly used for terrestrial applications, such as the RJ-45 style connector, have proved to be less than suitable for aerospace and other applications. In aerospace and other applications, electrical connectors are subjected to a variety of harsh environmental conditions, such as the presence of moisture, vibrations and mechanical shock, relatively high amounts of external electrical and magnetic interference, and pressure changes, all of which can detrimentally affect an electrical connector's performance, that is, its ability to transmit data signals while maintaining a relatively high signal to noise ratio. Common electrical connectors for aerospace and other suitable applications, such as the Quadrax-style connector, may work for data transfer rates less than 1 gigabit per second, but tend to exhibit, induce, generate or introduce excessive noise during high-speed data transmission at rates faster than 1 gigabit per second.

Because degraded performance of an electrical connector adversely affects the ability of a system to transfer data at high rates, the present inventor has recognized a need for a robust electrical connector capable of facilitating high-speed data transfer in aerospace and other suitable applications, for example, in aircraft electronic systems having performance criteria meeting gigabit data transfer standards such as 1000BASE-T. The present inventor has also recognized a need for an improved electrical connector with a streamlined design allowing for increased contact density within the connector housing and enhanced shielding capabilities to reduce interference and crosstalk. The present inventor has also recognized a need for such a connector that can be easily assembled and disassembled for repair and rework.

Additional aspects and advantages will be apparent from the following detailed description of preferred embodiments, which proceeds with reference to the accompanying drawings.

DETAILED DESCRIPTION OF PREFERRED EMBODIMENTS

Figure 1:
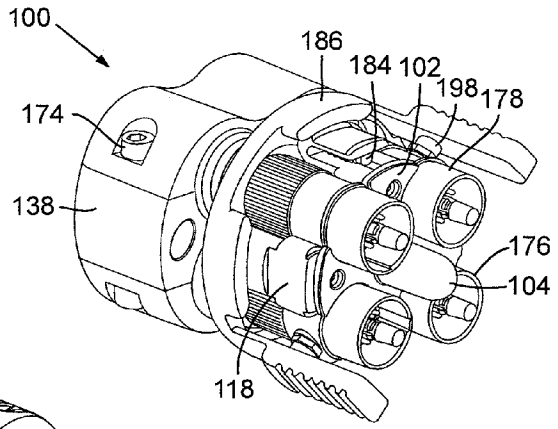
FIG. 1 is a perspective view of an electrical connector according to one embodiment.

With reference to the drawings, this section describes particular embodiments of various electrical connectors and their detailed construction and operation. Throughout the specification, reference to "one embodiment," "an embodiment," or "some embodiments" means that a particular described feature, structure, or characteristic may be included in at least one embodiment of an electrical connector. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like.

The following describes example embodiments of an electrical connector system with pairs of mating connectors (e.g., mating connectors 100, 200, mating connectors 300, 400, or mating connectors 500, 650). The electrical connector systems may be used to connect two cable segments together for high-speed data transfer, for example, data transferred at rates of 1 gigabit per second and faster by signals generated at frequencies ranging from approximately 100 MHz to approximately 600 MHz and faster. In the following description, particular components of each of the electrical connectors are described in detail. It should be understood that in some instances, well-known structures, materials, or operations are not shown or not described in detail to avoid obscuring pertinent aspects of the embodiments. In addition, although the embodiments may reference electrical connectors having a specific arrangement or number of pin and socket connectors (and contacts), other embodiments may include differently configured components adapted to house more or fewer pin connectors.

With reference to FIGS. 1-4, an electrical connector 100 includes a housing 138 having a central housing base 140 and a pair of interlocking exterior shells 160 for retaining pin connectors 176, 178 in a ganged, co-aligned configuration. Additional details relating specifically to housing 138 are discussed below with particular reference to FIG. 2. Electrical connector 100 also includes a spacer 118 sized to fit between the pin connectors 176, 178 for physically separating the pin connectors 176, 178 from one another and aligning the pin connectors 176, 178 in a desired orientation to properly engaging a mating connector 200 (see FIG. 5). The spacer 118 includes a central bore 122 that receives and secures a plug insert 102. To help retain the mating connectors 100, 200 in an interlocked configuration, a pin head 104 protruding from the plug insert 102 mates with a socket 208 of the mating connector 200, as described in further detail below.

Figure 3:
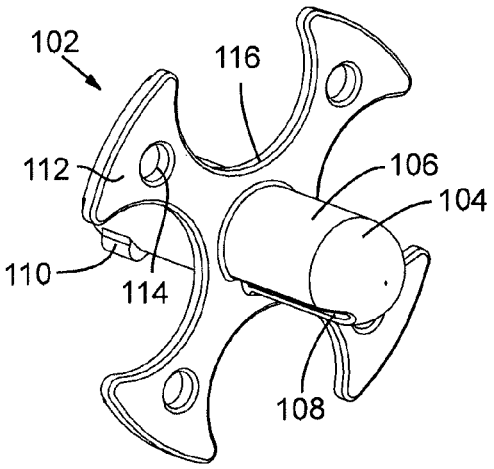
FIG. 3 is a perspective view of a plug insert of the electrical connector of FIG. 1.
Figure 4:
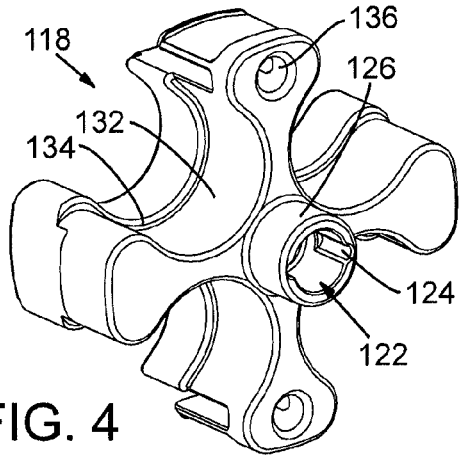
FIG. 4 is a rear perspective view of a spacer of the electrical connector of FIG. 1

FIGS. 3-4 illustrate detailed views of the plug insert 102 and the spacer 118, respectively. With particular reference to these figures, the plug insert 102 includes a cylindrically shaped central shaft 106 having a pin head 104 on one end. The pin head 104 includes an elongated channel 108 extending axially along a side surface of the pin head 104. Channel 108 receives a corresponding ridge 210 on a plug insert 206 of mating connector 200 (see FIG. 7) to help secure the connection and proper orientation between the connectors 100, 200 when mated. Central shaft 106 further includes a ridge 110 sized to slidably fit in a channel 120 formed within a central bore 122 of the spacer 118.

The plug insert 102 and the spacer 118 each include a plurality of blades 112, 128, respectively, fanning outwardly in a radial direction from the central shaft 106 and central bore 122, respectively. A pocket 116, 132 is formed between each of the blades 112, 128 to physically separate and accommodate the pin connectors 176, 178 as described previously. Each of these blades 112, 128 includes an opening or aperture 114, 130 sized to receive a screw, pin, or other suitable fastener (not shown) for securing the plug insert 102 against the spacer 118 when the connector 100 is assembled. In an assembled configuration, a back end (not shown, but opposite pin head 104) of the central shaft 106 on plug insert 102 is inserted through central bore 122 of spacer 118 such that ridge 110 aligns with and slides into channel 120. In such a configuration, plug insert 102 rests against or is flush with spacer 118, with pin head 104 extending outwardly from spacer 118 and blades 112 and apertures 114 aligning with and overlying blades 128 and apertures 130, respectively. To secure the plug insert 102 to spacer 118, a screw or other fastener is inserted through apertures 114, 130.

Preferably, the plug insert 102 and spacer 118 are each made of metal (e.g., aluminum), plastic, or other suitable material. The plug insert 102 and/or the spacer 118 may also be electroless nickel plated to help prevent corrosion and wear. In some embodiments, instead of the plug insert 102 and spacer 118 being formed as separate components that are thereafter attached to one another, the two components may be formed as a single monolithic structure.

Figure 2:
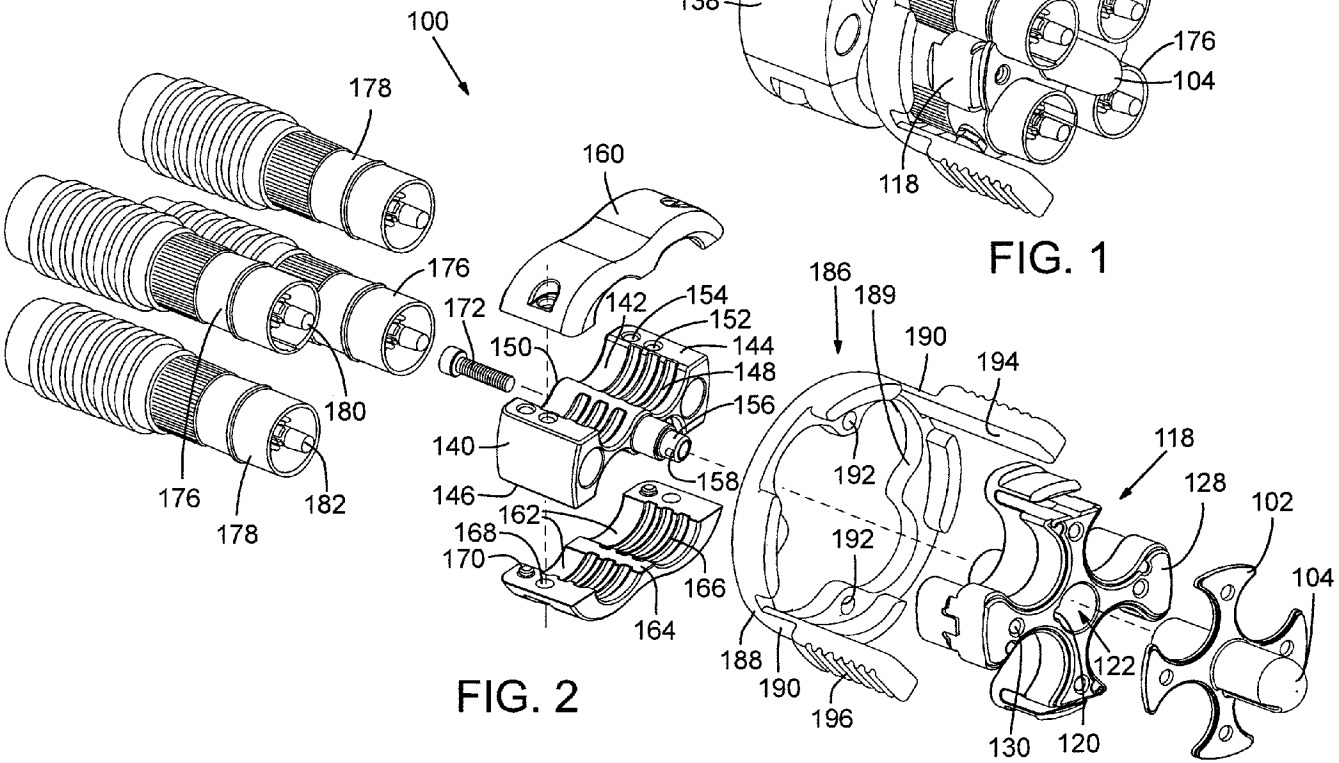
FIG. 2 is an exploded view of the electrical connector of FIG. 1.

The following sections describes additional details of the housing 138 with particular reference to FIG. 2. As illustrated in the exploded view, housing 138 may include a central housing base 140 and a pair of housing shells 160. In one embodiment, housing base 140 includes four generally U-shaped seats 142, with two seats on a top side 144 and two seats on a bottom side 146. Each seat 142 has a plurality of channels 148 extending transversely across the seat 142 to accommodate the pin connectors 176, 178 when in a fully assembled configuration as further described below. Housing base 140 includes a central bore 150 extending axially through the housing 138 and sized to receive a fastener 172 (see FIG. 2) for securing the components of the electrical connector 100 together.

Housing base 140 further includes mounting apertures 152 positioned on each of top and bottom sides 144, 146 and sized to receive a boss 170 for securing the housing shells 160 (as further described below) thereto. The housing shells 160 each include a pair of seats 162 having transversely oriented channels 166 (similar to seats 142 and channel 148) and a dividing wall 164 separating the seats 162. Shells 160 further include fastener apertures 168 corresponding in size and location to fastener apertures 154 of central housing base 140. Housing 138 may be made of metal, such as aluminum, plastic or other suitable materials, including insulating materials. In an assembled configuration, one of housing shells 160 is positioned on top side 144 of housing base 140 and the other housing shell 160 is positioned on bottom side 146 of housing base 140. Thereafter, the bosses 170 on housing shells 160 are snapped into apertures 152 on housing base 140 and screws 174 (see FIG. 2) are threaded through the fastener apertures 154, 168 to complete assembly of housing 138.

With general reference to FIGS. 2-4, the following description relates specifically to an example process for attaching spacer 118 to housing 138 to align pin connectors 176, 178 according to one embodiment. As shown in FIG. 4, spacer 118 includes a channel 124 formed within a cylindrical shaft 126. With reference to FIG. 2, a cylindrical stem 156 extends from a front end of the housing base 140 and bears a ridge 158 sized to slide within and sit in channel 124 of spacer 118. In an assembled configuration, spacer 118 is inserted into stem 156 such its shaft 126 wraps around stem 156 and ridge 158 slides into channel 124 to retain spacer 118 against stem 156. It should be understood that in other embodiments, the particular mating components of the electrical connector 100 may be reversed. For instance, in other embodiments, ridge 110 on plug insert 102 may instead be a channel and channel 124 on spacer 118 may instead be a mating ridge.

The previous sections provided some description regarding assembly of particular components of the electrical connector 100 (e.g., assembly of the housing 138, and mounting the plug insert 102 and spacer 118 together). The following section describes an example assembly of an electrical connector 100. In one assembly method of an electrical connector 100, prior to assembling the housing 138 as previously described, the pin connectors 176, 178 are positioned on or against seats 142 of central housing base 140. Once pin connectors 176, 178 are properly aligned on seats 142, housing shells 160 are positioned around housing base 140 to enclose pin connectors 176, 178 therein in a ganged, coaligned configuration. Thereafter, housing 138 is assembled as previously described to secure pin connectors 176, 178 in position.

After the pin connectors 176, 178 are seating in the housing 138, spacer 118 is fitted between pin connectors 176, 178, with blades 128 separating the individual pin connectors 176, 178 from one another. When spacer 118 is properly aligned, pin connectors 176, 178 rest against pocket 132 of spacer 118 and are held against a collar 134 of spacer 118 (see FIG. 4). Plug insert 102 may thereafter be mounted onto spacer 118 as previously described to complete assembly of the electrical connector 100. It should be understood that the assembly order described herein is for illustration purposes only and not intended as limiting. For instance, in other assembly methods, spacer 118 and plug insert 102 may be mounted together prior to fitting spacer 118 onto central housing portion 140.

Figure 5:
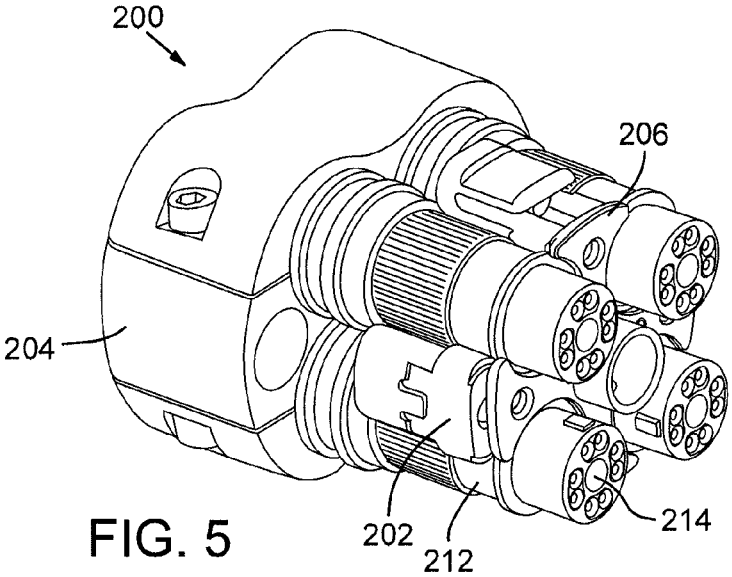
FIG. 5 is a perspective view of an electrical connector for mating with the electrical connector of FIG. 1.
Figure 7:
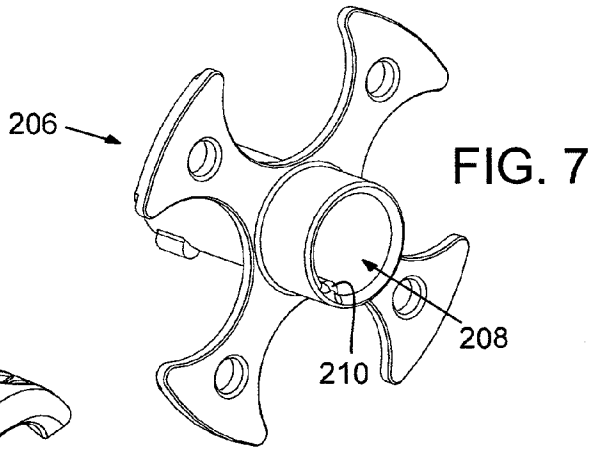
FIG. 7 is a perspective view of a plug insert of the electrical connector of FIG. 5.
Figure 6:
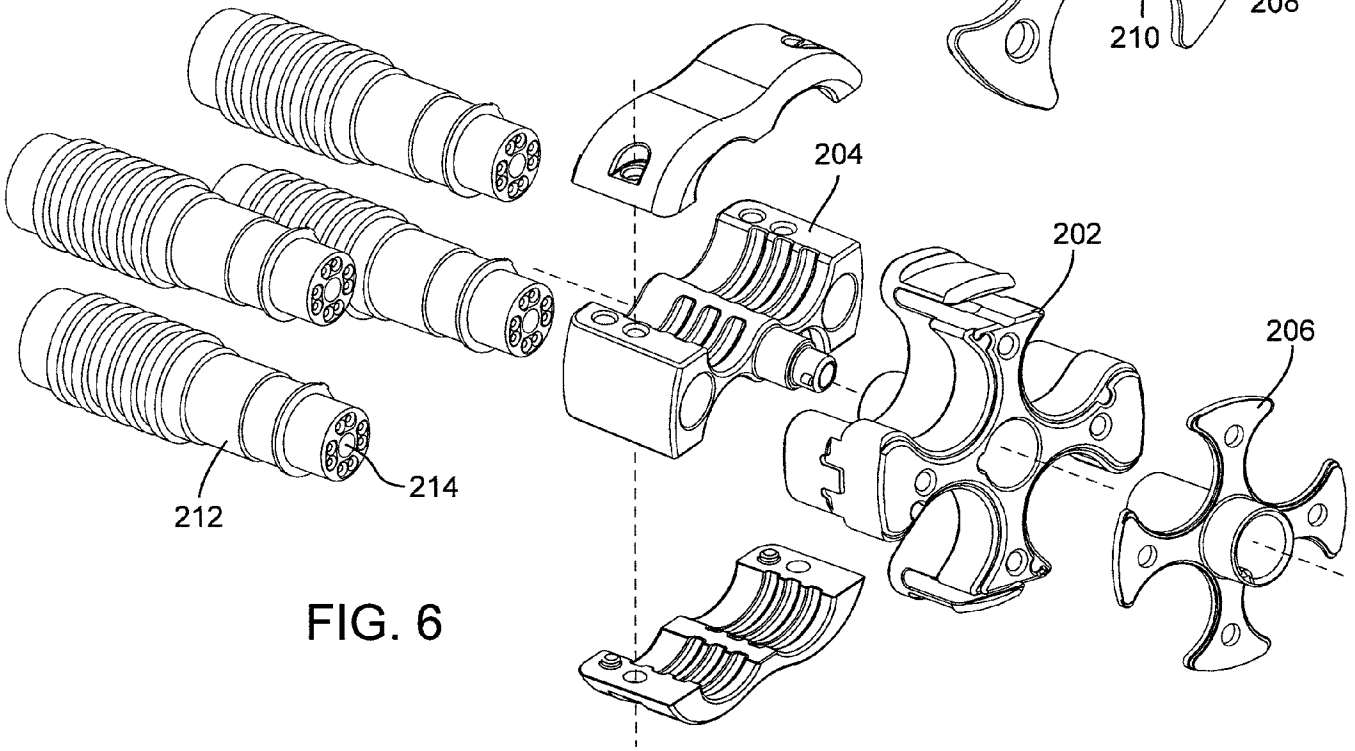
FIG. 6 is an exploded view of the electrical connector of FIG. 5.

FIGS. 5-7 illustrate an embodiment of an electrical connector 200 configured to mate with the electrical connector 100 of FIG. 1. Electrical connector 200 may include a similar or substantially identical spacer 202 and housing 204 components as described with reference to electrical connector 100. In addition, these components may be assembled in the same or similar process as described in relation to electrical connector 100. Accordingly, to avoid repetition, similar components will not be further described in detail with respect to electrical connector 200. As illustrated in FIG. 7, electrical connector 200 includes a plug insert 206 that has a few similar components as the plug insert 102 of electrical connector 100 (e.g., fanned out blades with mounting apertures), but also includes a socket 208 instead of the pin head 104. The socket 208 is sized to receive pin head 104 when the connectors 100, 200 are mated. In addition, the socket connectors 212 of the electrical connector 200 include a socket 214 sized to engage pins 180, 182 of pin connectors 176, 178. In such a configuration, electrical connector 100 may be inserted into mating connector 200. Once inserted, a latch mechanism 35 (described below in further detail with reference to FIG. 8) locks connectors 100, 200 in position.

Figure 8:
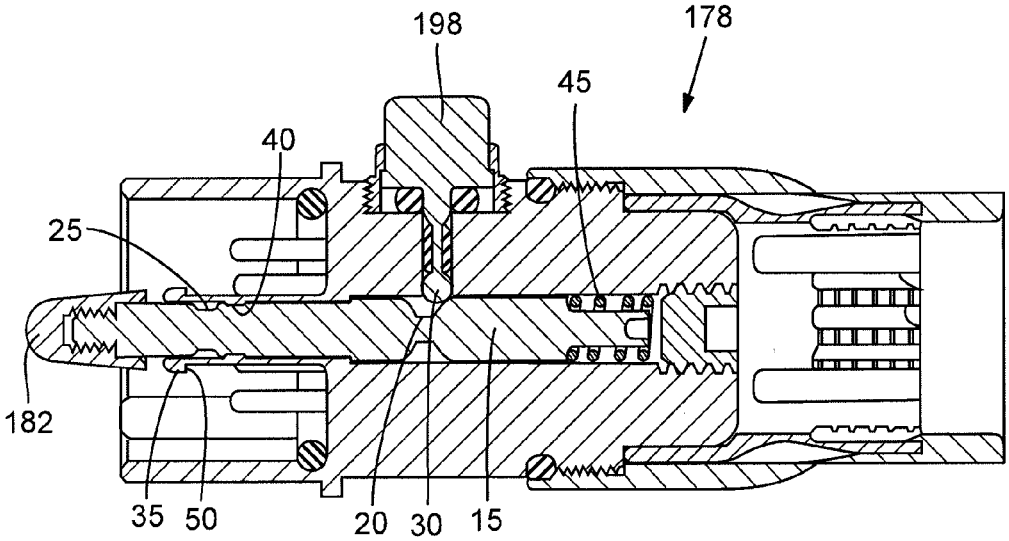
FIG. 8 is a cross-sectional view illustrating a latch mechanism of the electrical connector of FIG. 1.

FIG. 8 is a cross-sectional view illustrating an integrated latch mechanism 35 of the electrical connector 100 for latching together electrical connectors. The latch mechanism 35 includes lock pawls 50 that engage a corresponding structure (not shown) on the mating connector (e.g., connector 200) for retaining the connectors in a locked configuration. In some embodiments, pin connectors 178 of electrical connector 100 may include a latch release button 198 to disengage the lock pawls 50 and provide for easy release of electrical connector 100 from a mating connector 200 when needed.

With particular reference to FIG. 8, pin connector 178 includes a central shaft 15 having a first channel 20 and a second channel 25 thereon. When release button 198 is depressed downwardly toward shaft 15, an engagement bulb 30 at the end of button 198 moves into the first channel 20 and urges shaft 15 to retract inwardly against spring 45. When shaft 15 retracts, a groove 40 on a latch mechanism 35 slides into the second channel 25 and the latch mechanism 35 collapses downward, thereby releasing pin 178 from mating connector 200 and allowing easy removal. Other latching mechanisms actuated by a side-mounted button or other means are also contemplated within the scope of the present disclosure. Additional details of example embodiments for latch mechanism 35 are described in U.S. App. Pub. No. 2012/0171884, the disclosure of which is hereby incorporated by reference.

In some embodiments, only some of the pin connectors (e.g., pin connector 178) of electrical connector 100 will incorporate latch mechanism 35 and latch release button 198, while other pin connectors (e.g., pin connectors 8) will not have such locking/unlocking components. In such configurations, it may be easier to decouple electrical connector 100 from mating connector 200 since only two latch release buttons 198 will need to be depressed instead of requiring simultaneous actuation of four latch release buttons 198. In still other embodiments, electrical connector 100 may include only one pin connector with a latch mechanism and three connectors without a latch mechanism. It should be understood that in other electrical connectors, any number of pin connectors may include a latch mechanism.

In some embodiments, a grip bracket 186 may be fitted on electrical connector 100 to provide easier access to and actuation of release buttons 198 (see FIG. 2). Grip bracket 186 includes a round base 188 that encircles a base of pin connectors 176, 178 and may include pockets 189 for accommodating the pin connectors 176, 178. The grip bracket 186 includes a pair of cantilevered arms 190 extending outwardly from base 188 to provide a spring-return effect. Each of arms 190 includes an outward facing end with a textured or grooved surface 196 for enhancing user grip when pinching release buttons 198. In some configurations, a bottom surface 194 of grip bracket 186 may loosely contact (without fully depressing button 198 inwardly) or may instead overlie release buttons 198 with a small gap/clearance to separate the components. Grip bracket 186 may be formed of a plastic material or other material having suitable durability and strength characteristics.

In an example operation, release button 198 may be actuated by grasping and squeezing textured surface 196 on grip bracket 186, such as between a user's thumb and forefinger. The applied force depresses the arms 190 and actuates/depresses button 198 downwardly, which retracts shaft 15 in pin connector 178 to release latch mechanism 35 as described above.

In other embodiments, electrical connector 100 may comprise four pin connectors (similar to pin connectors 178) each having a latch mechanism 35 and a release button 198. In such embodiments, therefore, electrical connector 100 comprises four pin connectors 178 with four latch release buttons 198. To accommodate as design with the four release buttons 198, grip bracket 186 may include additional cantilevered arms (similar or identical to arms 190) so that one cantilevered arm 190 is positioned over each of the latch release button 198 to provide a convenient grasping mechanism for depressing all four latch release buttons 198 simultaneously. For instance, in an example operation, a user may grasp the grip bracket 186 in one hand and depress all four cantilevered arms at once to actuate all four latch release buttons 198. Thereafter, the user can pull apart and disengage the electrical connectors.

In some embodiments, grip bracket 186 may provide an additional structure for securing spacer 118. For instance, grip bracket 186 may include a mounting aperture 192 (see FIG. 2) sized to engage a corresponding aperture 136 on spacer 118 (see FIG. 4). In such embodiments, a fastener 184 may be threaded through apertures 192, 136 to fasten spacer 118 to grip bracket 186.

Figure 9:
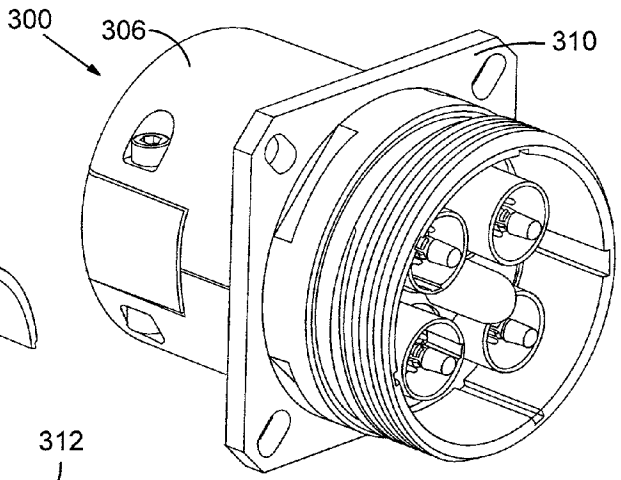
FIG. 9 is a perspective view of an electrical connector according to another embodiment.
Figure 10:
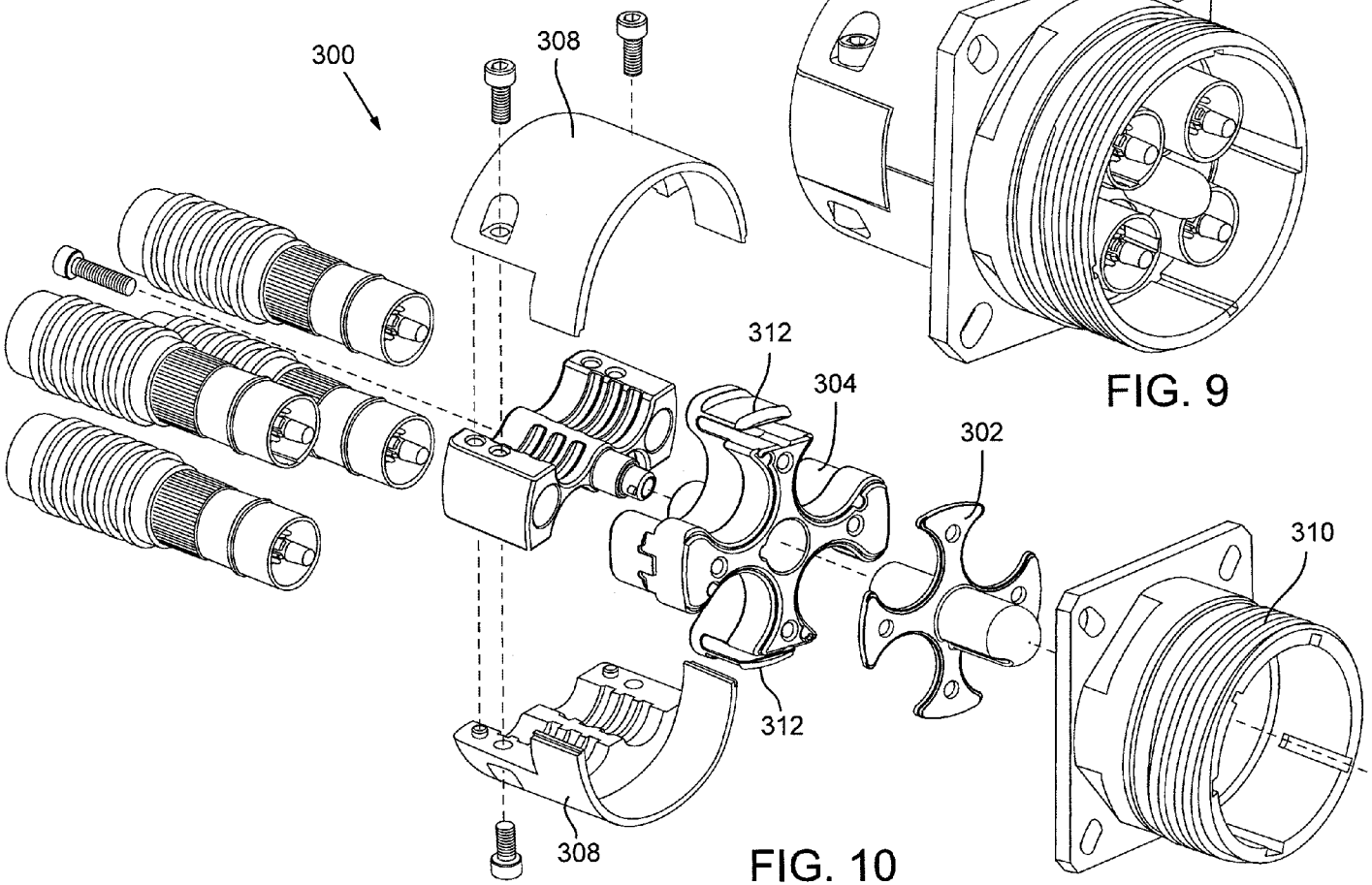
FIG. 10 is an exploded view of the electrical connector of FIG. 9.

FIG. 9 illustrates a perspective view of a different embodiment for an electrical connector 300 and FIG. 10 is an exploded view of the electrical connector 300. With particular reference to FIG. 10, electrical connector 300 includes a plug insert 302, a spacer 304, and a housing 306, all of which may include similar and/or identical functionality and components arranged as previously described with respect to electrical connector 100. In some embodiments, the housing 306 may include different upper and lower housing portions 308 to accommodate a shell 310 for different electrical connector types/configurations. For instance, in some embodiments, shell 310 may be compliant with a MIL-DTL-38999 connector.

Figure 11:
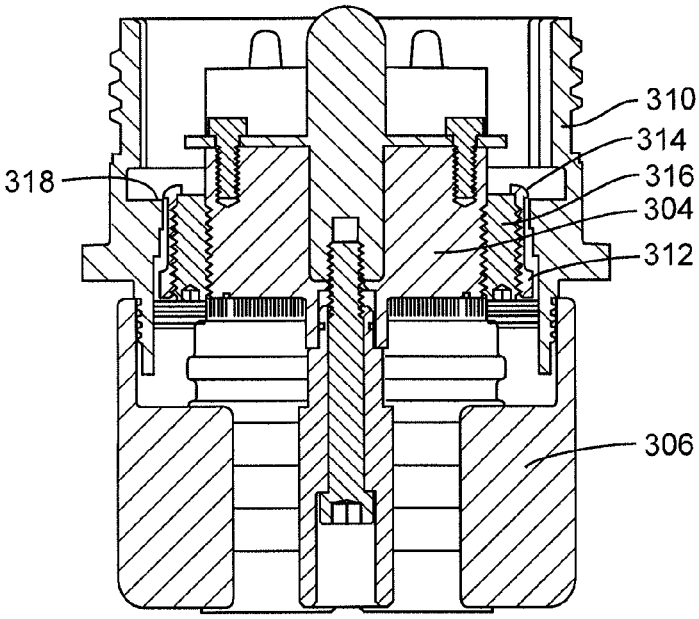
FIG. 11 is a cross-sectional view of the electrical connector of FIG. 9 illustrating an internal shell-retention mechanism.

In some embodiments, the electrical connector 300 may include a shell-retention mechanism to secure shell 310 against the housing 306. FIG. 11 is a cross-sectional view of the electrical connector of FIG. 9 illustrating an example embodiment of a shell-retention mechanism. In such embodiments, the spacer 304 of the electrical connector 300 includes at least one cantilevered tang 312 (also shown in FIG. 10) having a locking pawl 314 for receiving and locking the shell 310 in position. In an example assembly, shell 310 is threaded or otherwise inserted into housing 306. Once shell 310 is in proper position, a locking screw 316 is inserted and threaded through an aperture 136 (e.g., see FIG. 4) on tang 312. Threading screw 316 into aperture 136 urges tang 312 and toward a shoulder 318 of shell 310. Screw 316 is threaded into aperture 136 until locking pawl 314 of tang 312 is pushed far enough outward to abut and arrest shoulder 318 of shell 310. In such a configuration, tang 312 and locking pawl 314 resist movement of shell 310 away from electrical connector 300 and housing 306 (i.e., to inhibit disengagement of the shell 310). To remove shell 310, screw 316 is unscrewed, which relaxes tang 312 and collapses locking pawl 314 away from shoulder 318.

Figure 12:
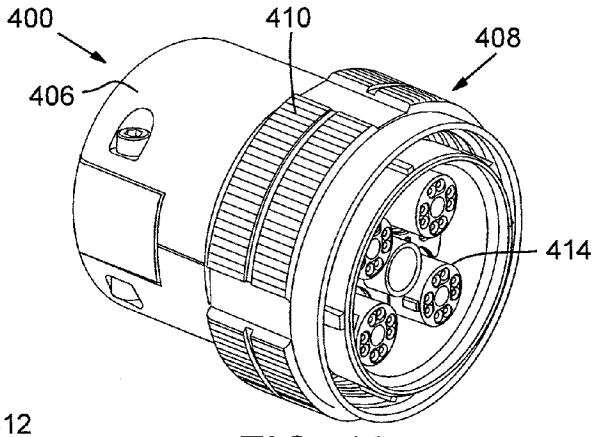
FIG. 12 is a perspective view of an electrical connector for mating with the electrical connector of FIG. 9.
Figure 13:
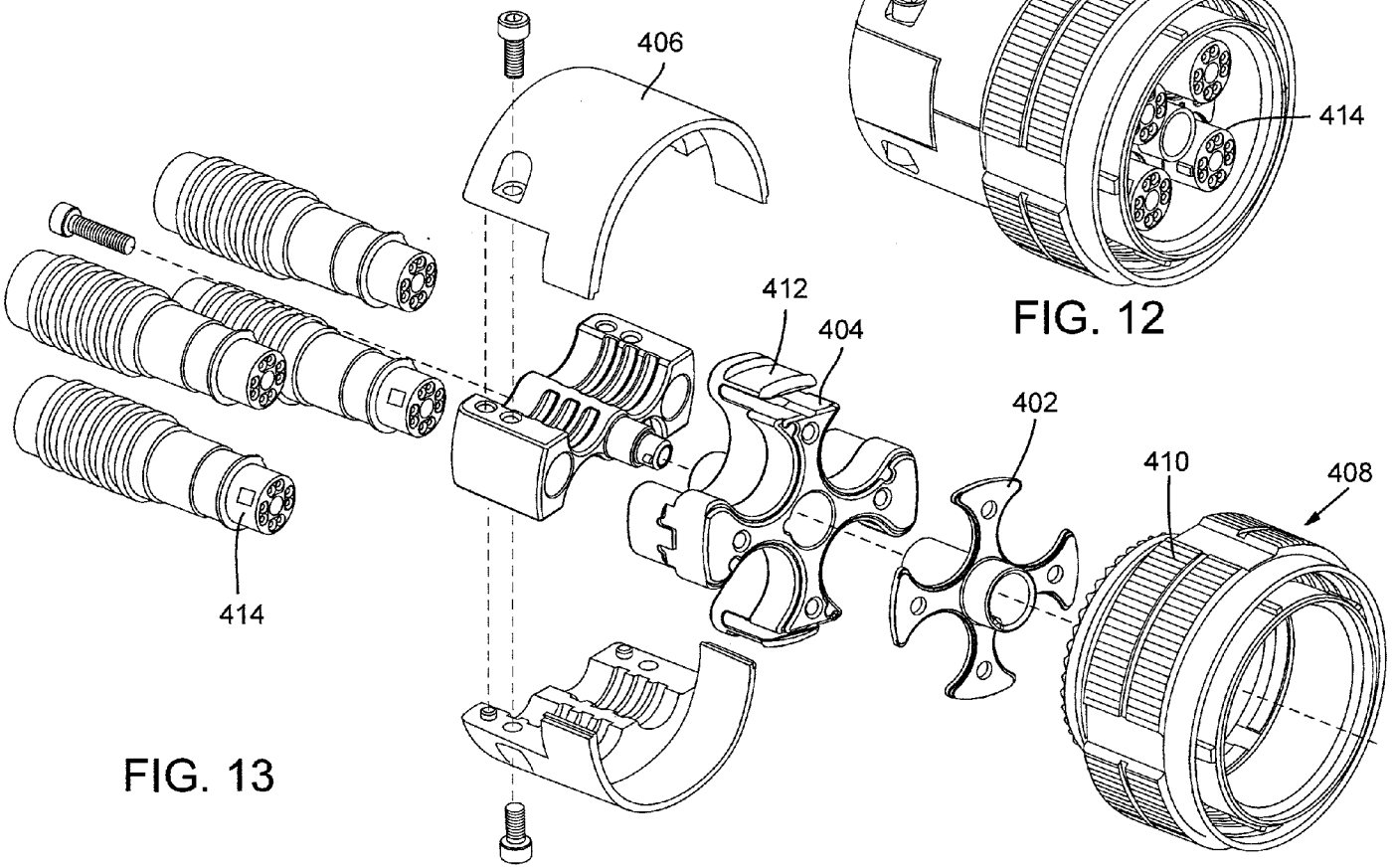
FIG. 13 is an exploded view of the electrical connector of FIG. 9.

FIGS. 12-13 illustrate an embodiment of an electrical connector 400 (e.g. MIL-DTL 38999 connector) configured to mate with electrical connector 300 of FIG. 9. Mating connector 400 includes a plug insert 402, spacer 404, and connectors 414 which may include the same or similar features as previously described with respect to electrical connector 200. Housing 406 may be similar to housing 306 of electrical connector 300. A shell 408, including a rotatable locking ring/nut 410 may be retained by electrical connector 400 via spacer 404 and tang 412 in a similar fashion as described with respect to shell 310 as illustrated in FIG. 11. Shell 408 is sized to engage shell 310 of electrical connector 300 when mating connector 400 and electrical connector 300 are linked. Locking ring 410 is threaded or provided with other means, such as a bayonet mount feature, for engaging and releasably joining shells 310 and 408.

FIGS. 14-24 illustrate another embodiment of a pair of mating electrical connectors 500, 650 designed to provide increased electrical contact density for each connector 500, 650 for improved performance of high-speed data transfer. In the electrical connector system, an electrical connector 500 interfaces with an electrical connector 650 to create an electrical connection between two cables (not illustrated for clarity). The following description proceed with details of the components of the electrical connector 500, followed by details of the electrical connector 650 (which preferably includes a number of identical parts as the electrical connector 500), and a description of an example coupling process of the connectors 500, 650.

Figure 14:
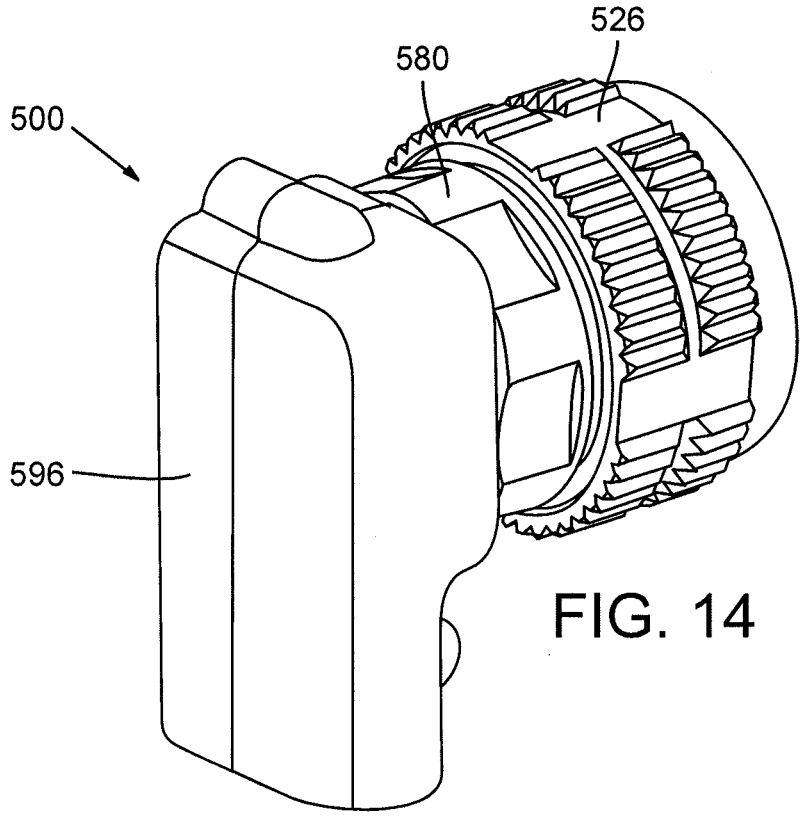
FIGS. 14-15 are perspective views of an electrical connector according to another embodiment.
Figure 15:
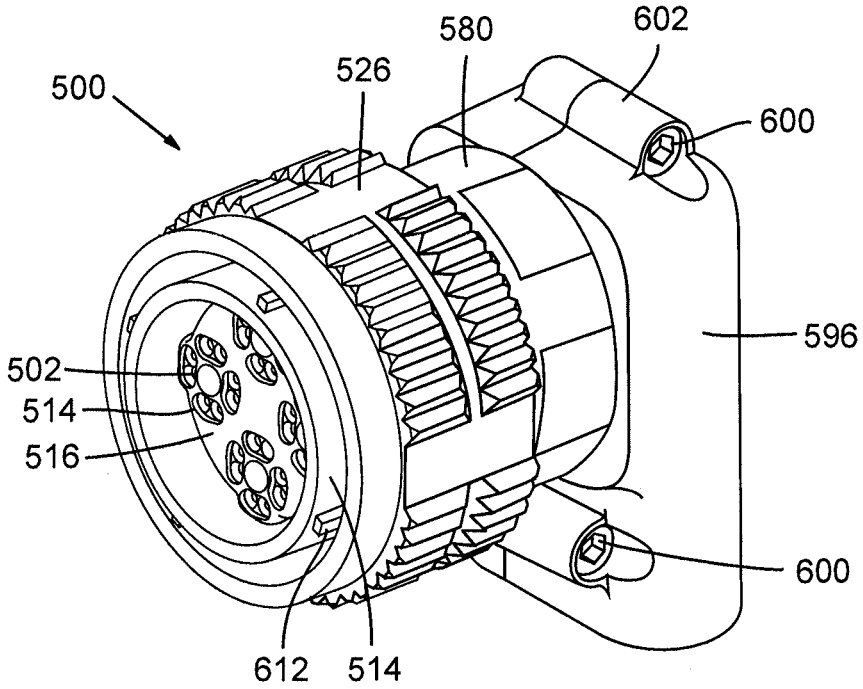
Figure 16:
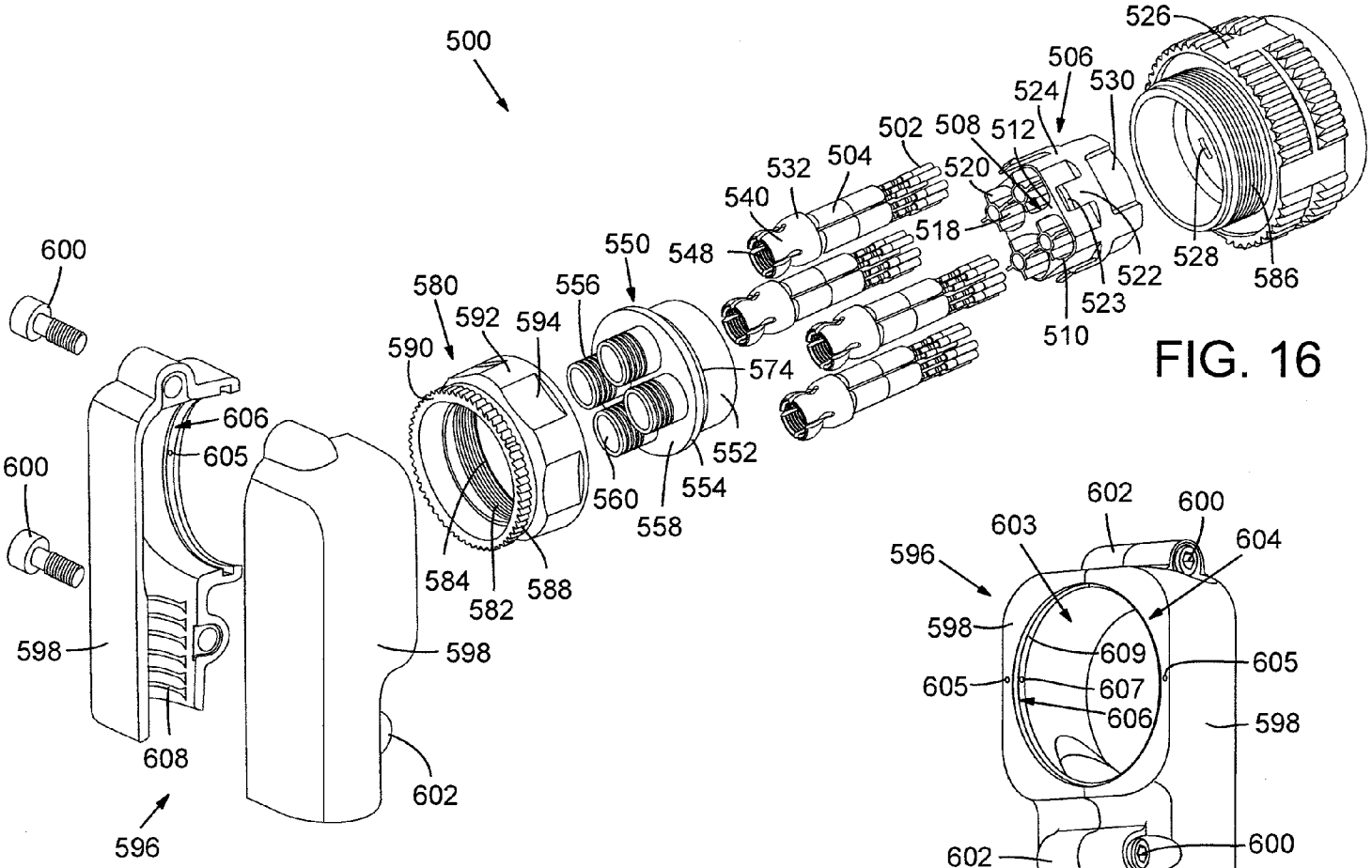
FIG. 16 is an exploded view of the electrical connector of FIG. 14.

FIGS. 14-15 illustrate perspective views of the electrical connector 500, and FIG. 16 illustrates an exploded view of the electrical connector 500 according to one embodiment. With reference to FIGS. 14-16, the electrical connector 500 includes multiple socket contacts 502 housed in an electrically insulating (or electrically non-conductive) sheath 504 to physically separate the socket contacts 502 from one another. The sheaths 504 are grouped together (shown in groups of four in FIG. 16) and seated within an electrically conductive shield ferrule 532. The electrical connector 500 further includes a shield housing 550 suited to receive and compress the shield ferrules 532 and align the socket contacts 502 for insertion into a plug insert 506. Additional details regarding the insulating sheaths 504, the shield ferrule 532, the shield housing 550, and the plug insert 506 are provided below.

As briefly described above, the insulating sheath 504 houses the socket contacts 502. In one embodiment, the insulating sheath 504 includes an interior chamber (not shown) with a pair of longitudinal channels running along a length of the sheath 504, the channels separated from each other by a dividing wall. A socket contact 502 is seated and secured in each of the channels, with the socket contact 502 positioned along a front face of the sheath 504. In such embodiments, each sheath 504 houses a pair of socket contacts 502 and maintains the socket contacts 502 physically separate from one another and properly aligned for mating with the electrical connector 650. In one embodiment, each insulating sheath 504 is molded or machined from a polymeric material, for example, fiber reinforced or unreinforced amorphous thermoplastic polyetherimide resin such as ULTEM® 1000, sold by Sabic Innovative Plastics IP B.V. Company of the Netherlands, or other suitable insulating material. Additional details of example embodiments for insulating sheaths 504 for retaining contacts are described in U.S. App. Pub. No. 2012/0171884, the disclosure of which has been previously incorporated by reference.

With reference to FIG. 16, the electrical connector 500 includes a plug insert 506 for housing and arranging the sheaths 504 and socket contacts 502. The plug insert 506 includes a plurality of cavities 508 arranged into distinct groups (four groups of cavities 508 are illustrated in FIG. 16). Each cavity 508 extends in an axial direction entirely through the plug insert 506 and has a rear opening 510 proximate a rear face 512 of the plug insert 506, and an opposite front opening 514 in a front face 516 of the plug insert 506 (see FIG. 15). The plug insert 506 further includes a conductive central core 518 extending in the axial direction through the plug insert 506 for each group of cavities 508. Conductive fins 520 radiate from the core 518 to physically separate adjacent cavities 508 from one another and to separate the sheaths 504 when inserted into the plug insert 506 as further described below. Preferably, the cavities 508 are sized and dimensioned to accommodate and surround a substantial portion of each insulating sheath 504 when the electrical connector 500 is assembled.

Figure 23:
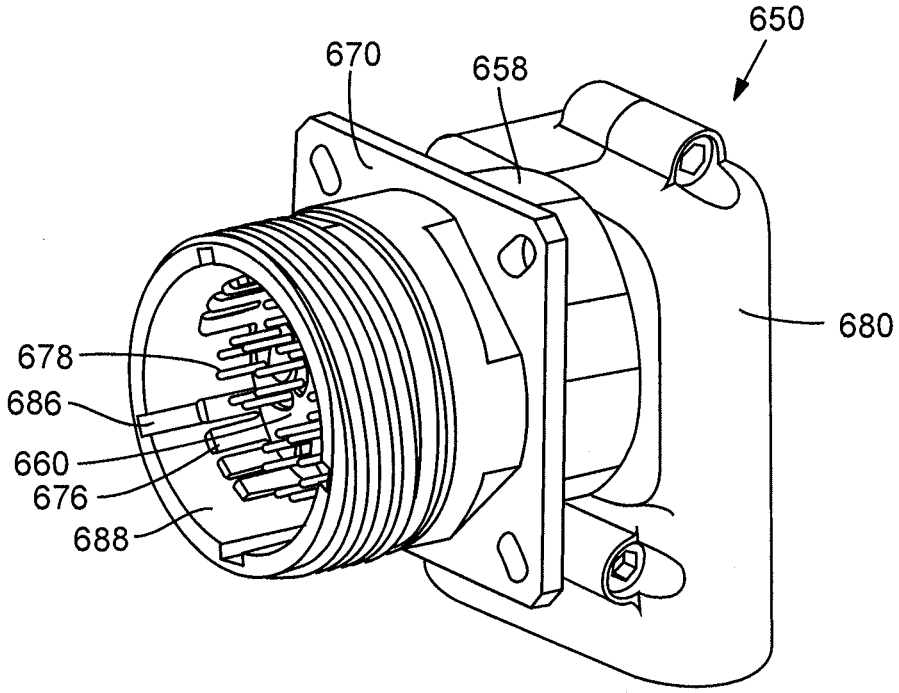

When the sheaths 504 are inserted into the plug insert 506, socket contacts 502 held by sheath 504 are aligned with the front openings 514 of the cavity 508 so that the socket contacts 502 can receive pin contacts 678 of the electrical connector 650 (see FIG. 23). When the sheaths 504 are housed in the cavities 508, the conductive core 518 may provide additional physical support to retain and secure the sheaths 504 in a desired alignment within the cavities 508.

In some embodiments, the number and arrangement of cavities 508 within the plug insert 506 will vary depending on a number and arrangement of sheaths 504 that will be housed therein and the size of the connectors 500, 650. For instance, FIGS. 14-16 illustrate one embodiment for a MIL-DTL-38999 size 19 connector designed to accommodate a total of sixteen sheaths 504 (and 32 total electrical contacts) separated into four groups of four. To accommodate the sheaths 504, the cavities 508 are also separated into four groups of four. In other embodiments, such as for a MIL-DTL-38999 size 25 connector, the plug insert may be larger and capable of housing thirty-two sheaths (and 64 total electrical contacts) separated into eight groups of four (such as connector 900 of FIG. 28). In still other embodiments, other arrangements and configurations are possible depending on the size and dimensional constraints of the connectors.

Figure 27:
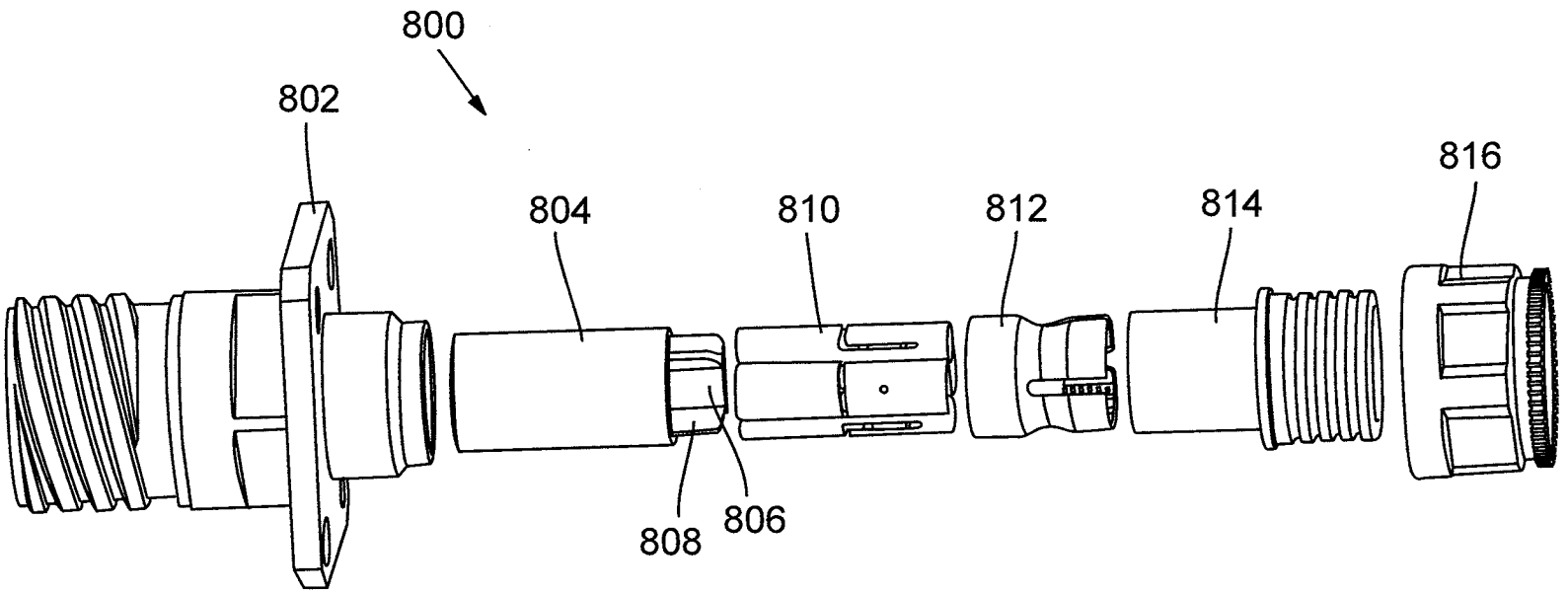
FIG. 27 is an exploded view of an electrical connector according to another embodiment.

For instance, FIG. 27 illustrates another embodiment of an electrical connector 800. The electrical connector 800 includes a shell 802 and a plug insert 804 with a plurality of cavities (not shown) similar to the plug insert 506 described previously with reference to FIG. 16. The plug insert 804 includes a single conductive central core 806 with radiating fins 808 for receiving and retaining a group of four sheaths 810, each sheath 810 housing electrical contacts (not shown). The connector 800 further includes a shield ferrule 812 and a shield housing 814 for retaining the sheaths 810 in a ganged, co-aligned configuration as further described in detail below with reference to the electrical connector 500 illustrated in FIG. 16. The shell 802 and a coupling nut 816 retain the components of the electrical connector 800 in place after assembly (as further described below with reference to FIG. 16). In some embodiments, the shell 802 may be sized for a MIL-DTL-38999 size 9 connector. As illustrated, the size 9 connector is designed to accommodate a total of four sheaths 810 (and 8 total electrical contacts).

Turning back to FIG. 16, preferably, the plug insert 506 includes a plurality of cantilever members or tangs 522 formed on the sides of an exterior surface 524 thereof, each tang 522 having a radially outwardly projecting portion or catch 523 located proximate a free end of the tang 522. In some embodiments, the plug insert 506 may include a total four tangs 522 on the exterior surface 524, with each tang 522 facing an opposite tang 522. When the electrical connector 500 is assembled, the plug insert 506 is inserted into the shell 526, and the catch 523 of the tang 522 snaps into a corresponding notch or slot 528 on an interior surface of the shell 526 to hold the plug insert 506 in position at a desired configuration. The flexibility of the tangs 522 allow for a less restrictive engineering tolerance of the dimensions of the plug insert 506 with respect to the shell 526. In addition, the tangs 522 also serve as guides for arranging the plug insert 506 within the shell 526 to ensure that the socket contacts 502 align with pin contacts 652 of the mating connector 650 (see FIG. 23). In other embodiments, the plug insert 506 may not have tangs 522 and the plug insert 506 may instead be press fit into the shell 526. In such embodiments, the engineering tolerance between the plug insert 506 and the shell 526 may be more restrictive to ensure a proper fit of the plug insert 506.

Figure 17:
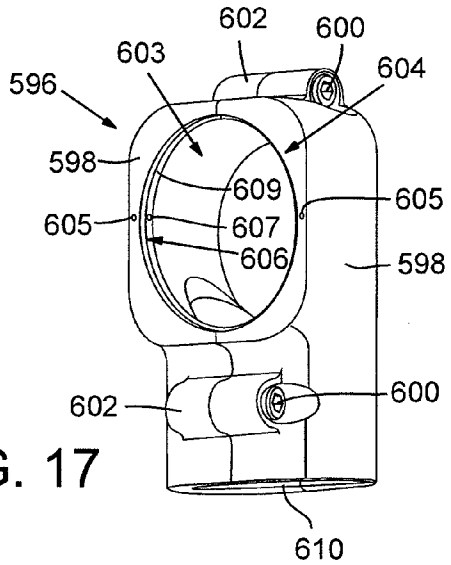
FIG. 17 is a perspective view of a shell housing of the connector of FIG. 14.

In some embodiments, the plug insert 506 includes a recessed surface 530 on the exterior surface 524, the recess 530 extending on the exterior surface 524 from the front face 516 toward the tangs 522. In some embodiments, the tangs 522 may be aligned with the recesses 530, where the tangs 522 are centered with respect to the recess 530 (as shown in FIG. 17), but other configurations are possible. As further described in detail below with reference to FIGS. 22-24, when the connectors 500, 650 are mated, the interference fit between the cantilevered fingers 676 of the electrical connector 650 (see FIG. 23) and the recess 530 provide a solid mechanical connection between the connectors 500, 650 and maintain shielding at the mating junction against external electromagnetic interference that may otherwise interfere with the cables terminated by the connectors 500, 650.

Figure 18:
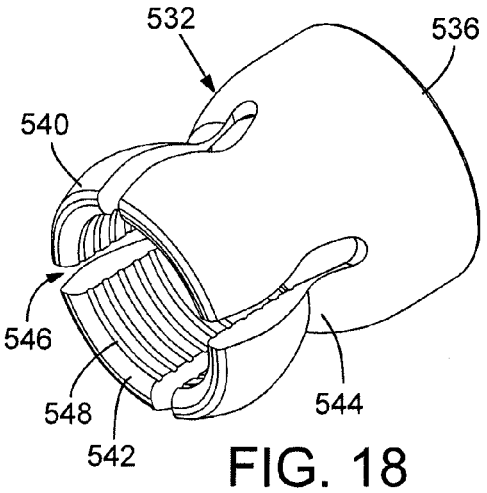
FIGS. 18-19 are rear and front isometric views of an electrically conductive shield ferrule of the connector of FIG. 14.
Figure 19:
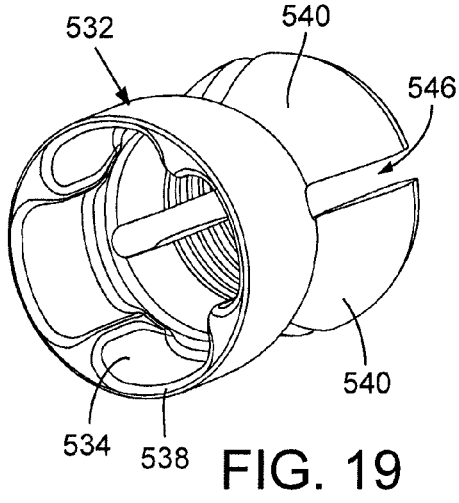

With particular reference to FIGS. 16 and 18-19, the electrical connector 500 further includes an electrically conductive, annular shield ferrule 532 for retaining the insulating sheath 504 in a ganged, co-aligned configuration. In some embodiments, as illustrated in FIG. 16, the shield ferrule 532 may retain four individual sheaths 504. In other embodiments, the ferrule 532 may retain more or fewer sheaths 504 as desired. With reference to FIGS. 18-19, the shield ferrule 532 includes a plurality of recesses 534 formed on an internal surface proximate a front end 536. Each recess 534 is sized to receive an end (or other portion) of the sheath 504. When assembled, each sheath 504 may snap into or otherwise sit within the recesses 534 to retain the sheaths 504 in a ganged alignment within the cavities 508 of the plug insert 506. In some embodiments, a radiused or chamfered surface 538 surrounds each recess 534 to accommodate the sheaths 504 and facilitate encircling the sheaths 504 with the shield ferrule 532.

The shield ferrule 532 further includes a plurality of cantilevered beams 540 formed on a back end 542, and a waist portion 544 positioned between the front and back ends 536, 542 of the shield ferrule 532. The waist portion 544 preferably has a smaller outer diameter than each of the ends 536, 542. In some embodiments, longitudinal slots 546 formed on the shield ferrule 532 may create the cantilevered beams 540 and provide clearance for flexing the rear end 542 of the shield ferrule 532. Additional details relating to the function/characteristics of the cantilevered beams 540 are described below with relation to the interaction between the shield ferrule 532 and the shield housing 550 in an assembled electrical connector 500.

Figure 20:
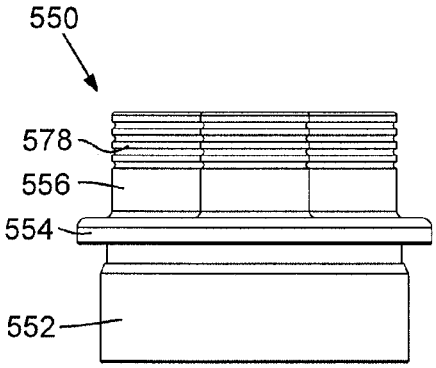
FIG. 20 is a side elevation view of a shield housing of the electrical connector of FIG. 14.
Figure 21:
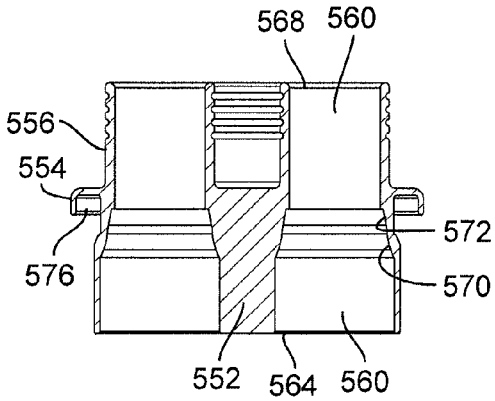
FIG. 21 is a cross-sectional view of the shield housing of FIG. 20.

With reference to FIGS. 16 and 20-21, a shield housing 550 includes a lower base 552, an upper head 558, and an annular lip 554 between the lower base 552 and the upper head 558. The shield housing 550 further includes a plurality of barrels 556 projecting in an axial direction from a surface of the upper head 558. With particular reference to FIGS. 20-21, a cavity 560 extends entirely through the shield housing 550 (and the barrels 556) in the axial direction, the cavity 560 having an opening in a rear face 564 of the shield housing 550, and an opposite opening in a front face 568 of the shield housing 550. With particular reference to FIG. 20, the lower base 552 includes an internal wall 570 that tapers inwardly to gradually narrow the size of the cavity 560. In some embodiments, the internal wall 570 may constantly taper inwardly from the rear face 564 to a narrow point 572 of the cavity 560.

In other embodiments (as illustrated in FIG. 21), the internal wall 570 may have no taper at the rear face 564, but begin tapering inwardly at a point distal from the rear face 564.

When the electrical connector 500 is assembled, the shield ferrules 532 are inserted through the cavity 560 along the rear face 564 of the shield housing 550. As the shield ferrules 532 are inserted, the sloped internal wall 570 urges the beams 540 to flex radially inwardly and constrict or narrow the back end 542 and the waist portion 544 of the shield ferrule 532. As described previously, the shield ferrules 532 retain a back end of the sheaths 504. When the sheaths 504 are inserted into the plug insert 506 and the shield ferrules 532 are inserted into the cavity 560 of the shield housing 550, this constriction of the waist portion 544 urges forward movement of the sheaths 504 within the cavity 508 so that the socket contacts 502 are urged forward against the front opening 514 of the cavity 508 (see FIG. 16). The radially inward flexure of the cantilever beams 540 may also cause beams 540 to clamp around wires/cables of the electrical connector 500 running through the shield ferrule 532. Internal grooves 548 on each of the cantilever beams 540 facilitate gripping these wires/cables and provide strain relief as the cantilever beams 540 are flexed inwardly.

In some embodiments, the shield housing 550 may include a seal 574 retained in an internal channel 576 underneath the lip 554 (see FIG. 21). The seal 574 functions to hinder moisture, dust, or other contaminants from entering the electrical connector 500. As is further described in detail below, to help retain the seal 574 in position, the seal 574 may be compressed into the channel 576 by the rear face 512 of the plug insert 506 when the electrical connector 500 is assembled. In addition (or in an alternative embodiment), each of the barrels 556 include a plurality of circumferential grooves 578 on the exterior surface. A moisture ingress resistant seal may be formed over the barrels 556 by an adhesive-lined heat-shrink tube (not shown) that forms O-ring like seals in grooves 578 when the adhesive melts and re-solidifies.

With particular reference to FIG. 16, the electrical connector 500 further includes a coupling nut 580 and a backshell 596, which, together with the shell 526, house the components of the electrical connector 500. The coupling nut 580 includes a threaded interior surface 582 proximate a rear end 584. The threaded interior surface 584 is threaded to a pitch size that corresponds to a threaded external surface 586 of the shell 526. A plurality of external teeth 588 are formed along an external circumference of the coupling nut 580 adjacent a front end 590 thereof. The teeth 588 may be regularly spaced-apart features, such as a series of evenly spaced vertical grooves, ridges, or other suitable features. In some embodiments, the teeth 588 are formed at approximately 5-degree intervals along the external circumference of the front end 590 of the coupling nut 580 for a total of 72 evenly-spaced teeth. In other embodiments, the coupling nut 580 may include more or fewer teeth that may be spaced apart at different intervals as desired. As is further described in detail below, the teeth 588 rest within an internal channel 606 of the backshell 596 and help prevent undesired rotation of the coupling nut 580. The coupling nut 580 also includes a grip surface 592, which may have a series of recessed portions or flats 594 or other suitable elements, to provide a gripping surface for tightening the coupling nut 580 onto the shell 526 during assembly of the electrical connector 500 as is further described in detail below.

As illustrated in FIG. 16, the backshell 596 preferably includes two clamshell housing sections 598 that may be fastened or mounted together, such as by inserting and securing fasteners 600 in the mounts 602. The housing sections 598 may each have identical features that cooperate with one another to create various components of the backshell 596 as further described below. With particular reference to FIG. 17, the backshell 596 includes an opening 603 on a front face 604 and the circumferential internal channel 606 (with each housing section 598 forming half of the channel 606) is formed adjacent to and recessed relative to the opening 603. The backshell 596 includes a pinhole slot 605 on each of the front faces 604 of the housing sections 598, and a second slot 607 on an interior wall 609. The pinhole slots 605, 607 are coaxially aligned relative to one another and configured to receive and retain a lock pin (not shown).

With reference to FIGS. 16 and 17, when the electrical connector 500 is assembled, the housing sections 598 of the backshell 596 are positioned around either side of the front end 590 of the coupling nut 580. The housing sections 598 are brought together so that the teeth 588 of the coupling nut 580 are positioned within the internal channel 606 of the backshell 596 and may rest against the internal wall 609. When the housing sections 598 are brought together, the lock pins move into position between a corresponding pair of teeth 588 (e.g., the lock pin sits in a valley between adjacent teeth 588). In this configuration, the lock pins arrest the coupling nut 580 and prevent undesirable loosening and/or rotation of the coupling nut 580 (such as may occur in response to vibrations or other external forces) after it has been tightened onto the shell 526.

Preferably, the clamshell housing 596 includes an integrally formed strain relief 608 (with each housing section 598 forming half of the strain relief 608) adjacent a rear end 610 to provide a biting engagement against cables or other wiring of the electrical connector 500. As illustrated in FIG. 16, strain relief 608 may provide an exit pathway oriented at 90-degrees (relative to a central axis of the electrical connector 500) for a cable or other wiring (not shown). In other embodiments, strain relief 608 may provide a differently angled exit pathway, such as 30-degrees, 45-degrees, 60-degrees, or another angle as desired. Alternatively, the strain relief 608 may provide a straight exit pathway (i.e., aligned with the central axis of the electrical connector 500).

Preferably, plug insert 506, shield ferrule 532, shield housing 550, coupling nut 580, and clamshell housing 596 are each made from an electrically conductive material, such as silver plated T6-7075 aluminum, for example. Other suitable materials, such as gold, nickel, aluminum alloys, steel, copper may also be used to coat or plate these components. In some embodiments, the components may be made from an insulating material, such as polyetherimide or other suitable engineering plastics, that is coated or plated with an electrically conductive material, such as silver, gold, or nickel. In a preferred embodiment, the plug insert 506, shield ferrule 532, shield housing 550, and coupling nut 580 are each machined or otherwise manufactured (e.g. molded, injection molded, casted, etc.) as single, monolithic structures.

The following description relates to an example assembly operation of the electrical connector 500, according to one embodiment. It should be understood that the described assembly steps are for illustration purposes only and do not intend to delineate any particular order for assembling the electrical connector 500. With particular reference to FIG. 16, the sheaths 504 bearing the socket contacts 502 are inserted into the cavities 508 of the plug insert 506. The front face of the sheath 504 is inserted into the cavity 508 so that the socket contact 502 is aligned with the front opening 514 on the front face 516 of the plug insert 506 (see FIG. 15). To ensure that the sheaths 504 are inserted in a proper orientation, the sheaths 504 and cavities 508 may have matching cross sections (e.g., matching kidney-shaped cross sections) or other keyed features. Once all sheaths 504 have been inserted, each group of sheaths 504 (illustrated as a group of four in FIG. 16), are banded together with an individual shield ferrule 532 (a total of four shield ferrules 532 are used in this embodiment). Each sheath 504 is inserted into the recess 534 on the front end 536 of the shield ferrule 532 (see FIG. 18). When fully assembled, the shield ferrule 532 may sit against the rear face 512 of the plug insert 506.

The shield housing 550 is thereafter positioned over the shield ferrules 532 to retain the four ferrules 532 in position. As described previously with respect to FIGS. 19-20, the cantilever beams 540 of the shield ferrule 532 are inserted into the cavities 560 of the shield housing 550. The cantilever beams 540 are constricted by the tapering internal wall 570, which in turn constricts the waist portion 544 to urge the sheaths 504 forward into the cavities 508 of the plug insert 506 as previously described.

The subassembly comprising of the plug insert 506 and the shield housing 550 are then inserted and pushed into the shell 526 until the tangs 522 of the plug insert 506 snap into the notches 528 on the interior of the shell 526. In some embodiments, the shield housing 550 may be dimensioned with respect to the interior of the shell 526 so that there is a slight interference fit (e.g., 0.001-0.002 inches) when the shield housing 550 is inserted into the shell 526. Once the subassembly is latched and retained within the shell 526, the coupling nut 580 is threaded onto the shell 526. In some embodiments, the coupling nut 580 may first be threaded by hand, and then a tool (e.g., a wrench) may be used to apply a desired amount of torque to tighten the coupling nut 580.

Once the coupling nut 580 is threaded onto and secured to the shell 526, the clamshell housing sections 598 are positioned on either side of the coupling nut 580 so that the teeth 588 of the coupling nut 580 are seated within the internal channel 606 of the backshell 596 to prevent rotation or loosening of the coupling nut 580. The clamshell housing sections 598 are then secured via the fasteners 600 to complete the electrical connector 500.

Figure 22:
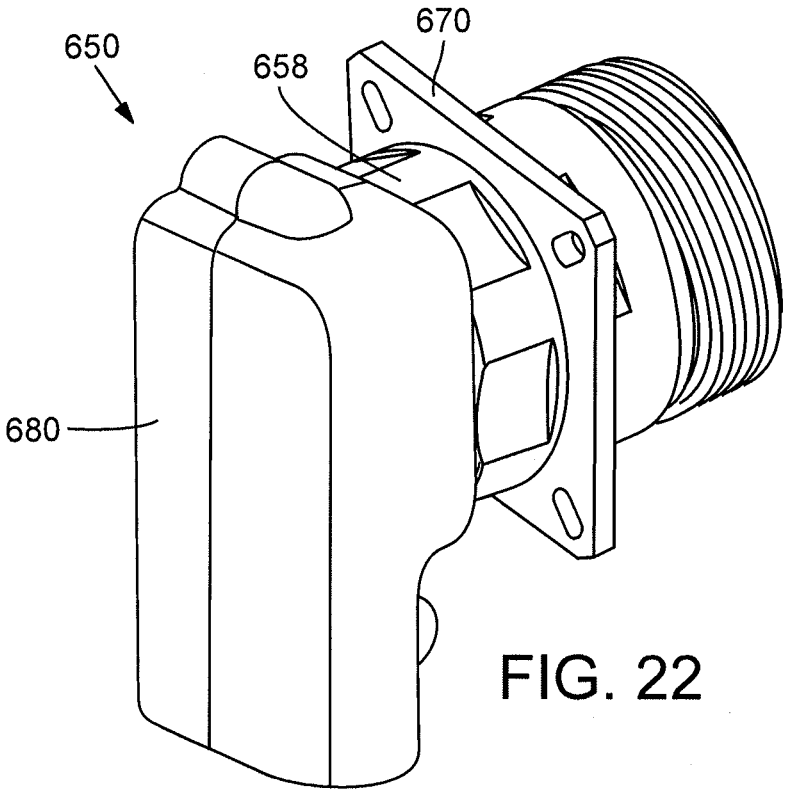
FIGS. 22-23 are perspective views of an electrical connector for mating with the electrical connector of FIG. 14.
Figure 24:
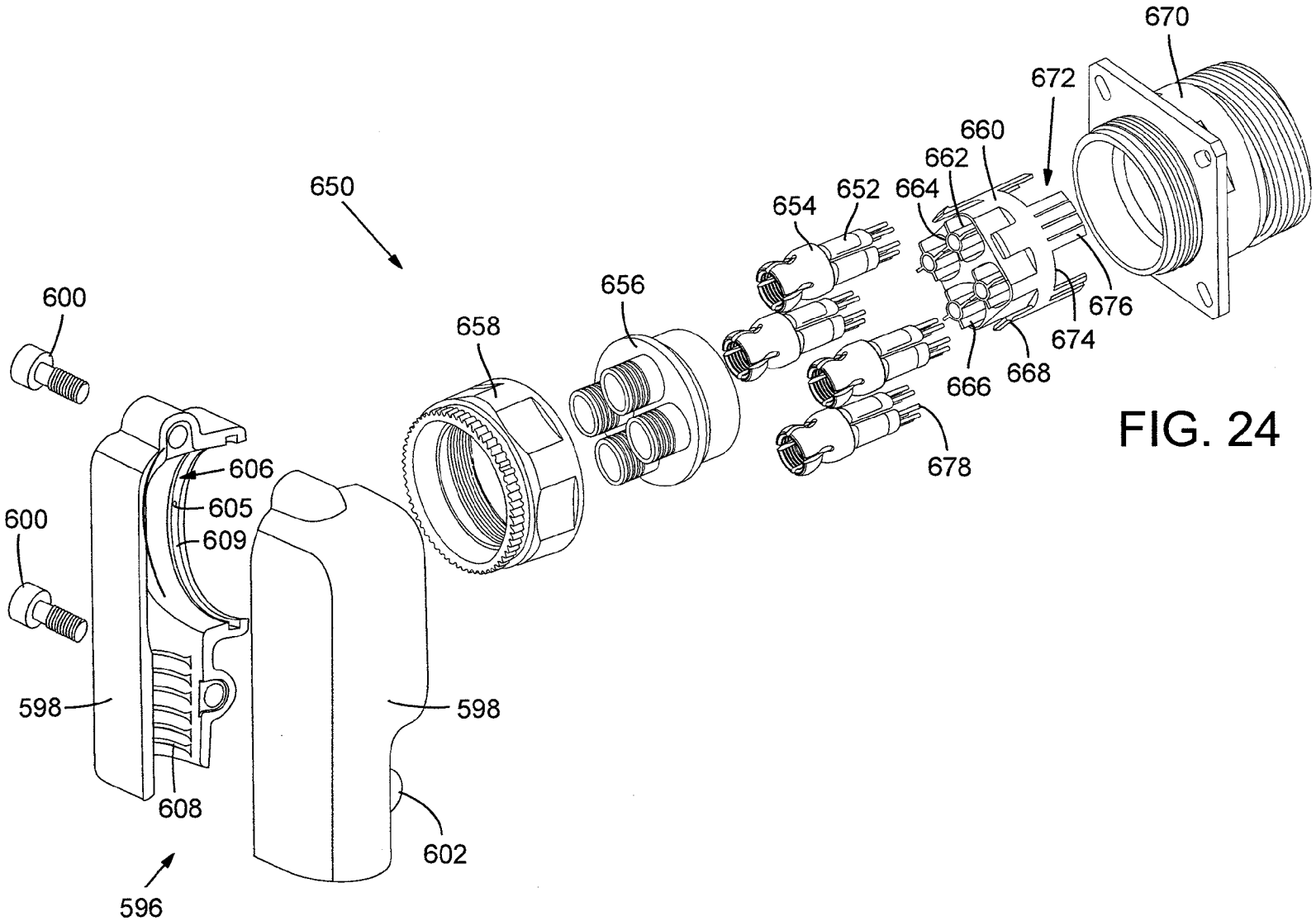
FIG. 24 is an exploded view of the electrical connector of FIG. 22.

FIGS. 22-24 collectively illustrate an embodiment of an electrical connector 650 that mates with the electrical connector 500. In some embodiments, electrical connector 650 includes many identical or substantially similar components as the electrical connector 500 and may be assembled in an identical fashion. For instance, with particular reference to FIG. 24, the electrical connector 650 includes insulating sheaths 652, shield ferrules 654, a shield housing 656, and a coupling nut 658, each preferably having identical features and arranged in an identical configuration as the corresponding components of the electrical connector 500. To avoid repetition, details relating to these components of the electrical connector 650 may not be further described. The following description highlights certain components and features of the electrical connector 650 that are different from the electrical connector 500.

With reference to FIG. 24, the electrical connector 650 includes a plug insert 660 that is similar to the plug insert 506 of the electrical connector 500. For instance, plug insert 660 includes cavities 662 separated by a central core 664 and radiating fins 666 in an identical arrangement as described with respect to plug insert 506. In addition, plug insert 660 includes tangs 668 for snapping the plug insert 660 into position within the shell 670, which is preferably a MIL-DTL-39999 size 19 connector shell. Plug insert 660, however, does not include recesses 530, but instead includes tongues 672 extending from a front end 674 of the plug insert. The tongues 672 may be divided or sectioned to form a plurality of cantilevered fingers 676 with a corresponding length to bear against the conductive recesses 530 of the plug insert 506 (see FIG. 16). Preferably, the fingers 676 engage the recesses 530 with an interference fit of approximately 0.001-0.002 inches to provide a solid mechanical connection between the connectors 500, 650 and maintain shielding at the mating junction against external electromagnetic interference that may otherwise interfere with the cables terminated by the connectors 500, 650.

With reference to FIG. 24, the insulating sheath 652 of the electrical connector 650 houses pin contacts 678 with at least a portion of the pin contacts 678 extending forwardly from an end of from the sheath 652 so that the pin contacts 678 can be inserted into the socket contacts 502 when coupling the connectors 500, 650. The electrical connector 650 includes a backshell 680 that preferably has similar features to backshell 596, including the strain relief 682, and the internal channel 684 for retaining the coupling nut 658 in position.

The following section describes an example coupling of the electrical connectors 500, 650 according to an example embodiment. With particular reference to FIG. 15, electrical connector 500 includes a plurality of splines 612 on an interior surface 614 of the shell 526. Similarly, electrical connector 650 includes a plurality of channels 686 on an interior surface 688 of the shell 670 (see FIG. 23). To couple the connectors 500, 650, the splines 612 of the electrical connector 500 are aligned with the channels 686 of the electrical connector 650. The splines 612 and the channels 686 are positioned on the respective connectors 500, 650 to ensure that the connectors 500, 650 are properly oriented relative to one another so that the pin contacts 678 are aligned with the socket contacts 502 and the cantilevered fingers 676 are aligned with the recesses 530. Once the splines 612 and channels 686 are aligned, the connectors 500, 650 are pushed together toward one another until the pin contacts 678 are inserted into the socket contacts 502 and the fingers 676 bear against the recesses 530. The connectors 500, 650 may be disengaged by pulling the respective connectors 500, 650 in opposite directions.

Figure 25:
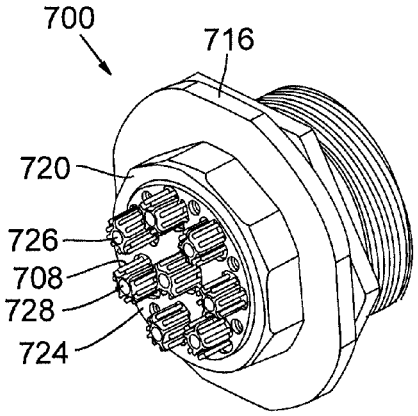
FIG. 25 is a perspective view of an electrical connector according to another embodiment.
Figure 26:
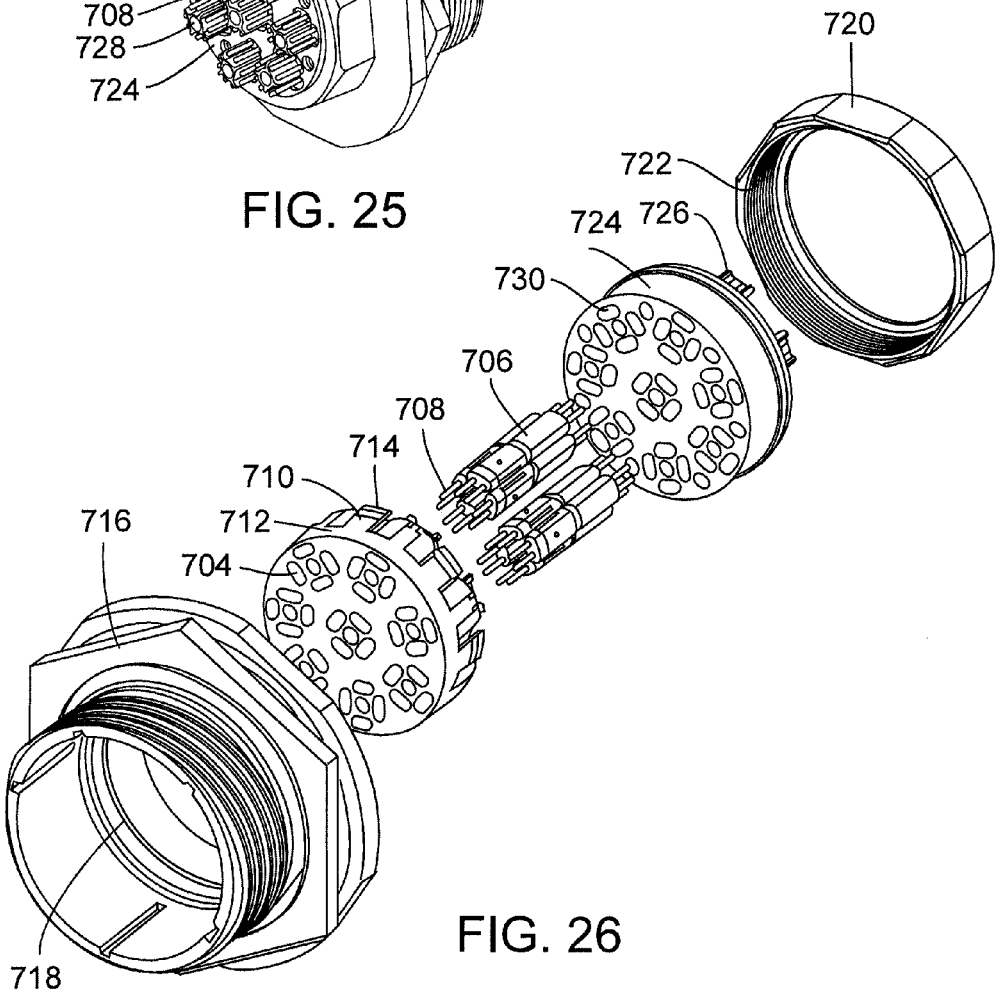
FIG. 26 is an exploded view of the electrical connector of FIG. 25.

FIGS. 25-26 collectively illustrate another embodiment of an electrical connector 700. In some embodiments, the electrical connector 700 may be a PCB connector and include many substantially similar components as the electrical connector 500. For instance, with particular reference to FIG. 26, the electrical connector 700 may include a plug insert 702 (similar to plug insert 506) that has a plurality of cavities 704 extending axially through the plug insert 702 (similar to cavities 508 of plug insert 506) for receiving sheaths 706 that house PCB contacts 708. The plug insert 702 further includes conductive central cores (not shown) similar to the cores 518 of the plug insert 506.

The plug insert 702 includes a plurality of cantilever members or tangs 710 formed on the sides of an exterior surface 712 thereof, each tang 710 having a radially outwardly projecting portion or catch 714 located proximate a free end of the tang 710. When the electrical connector 700 is assembled, the plug insert 702 is inserted into the shell 716, and the catch 714 of the tang 710 snaps into a corresponding notch or slot 718 on an interior surface of the shell 716 to hold the plug insert 702 in position. In addition, the electrical connector 700 includes a coupling nut 720 with a threaded interior surface 722 that may be threaded onto the shell 716 in a similar fashion as described with reference to FIG. 16 and electrical connector 500. To avoid repetition, details relating to these components of the electrical connector 700 may not be further described.

With reference to FIGS. 25 and 26, the electrical connector 700 includes a PCB contact isolator 724 for retaining and isolating the sheaths 706 and PCB contacts 708 in a ganged, co-aligned configuration. The PCB contact isolator 724 includes a plurality of conductive central cores 726 each extending in the axial direction from a surface of the PCB contact isolator 724. Conductive fins 728 radiate from the core 726 and physically separate adjacent pairs of PCB contacts 708 from one another around the central core 726 (see FIG. 25).

The following description relates to an example assembly operation of the electrical connector 700, according to one embodiment. It should be understood that the described assembly steps are for illustration purposes only and do not intend to delineate any particular order for assembling the electrical connector 700. With reference to FIGS. 25-26, the sheaths 706 bearing the PCB contacts 708 are inserted into the cavities 704 of the plug insert 702. Once all sheaths 706 have been inserted, the PCB contact isolator 724 may be positioned over the sheaths 706 so that the sheaths are inserted through the openings 730 of the PCB contact isolator 724. In this configuration, each pair of PCB contacts 708 is positioned between two fins 728 of the conductive core 726 (see FIG. 25).

The subassembly comprising of the plug insert 702 and the PCB contact isolator 724 are then inserted and pushed into the shell 716 until the catch 714 of the tangs 710 snap into the notch 718 on the interior of the shell 716. Once the subassembly is latched and retained within the shell 716, the coupling nut 720 is threaded onto the shell 716 to complete the electrical connector 700. In some embodiments, the coupling nut 720 may first be threaded by hand, and then a tool (e.g., a wrench) may be used to apply a desired amount of torque to tighten the coupling nut 720.

For clarity, FIG. 26 only illustrates two groups of sheaths 706 that may be inserted into cavities 730 of PCB contact isolator 724. However, in the embodiment illustrated in FIG. 26), the PCB contact isolator 724 may be able to accommodate eight groups of sheaths 706 (for a total of 32 sheaths and 64 PCB contacts). It should be understood that in different embodiments, the PCB contact isolator 724 may accommodate more or fewer sheaths and PCB contacts as desired.

Figure 28:
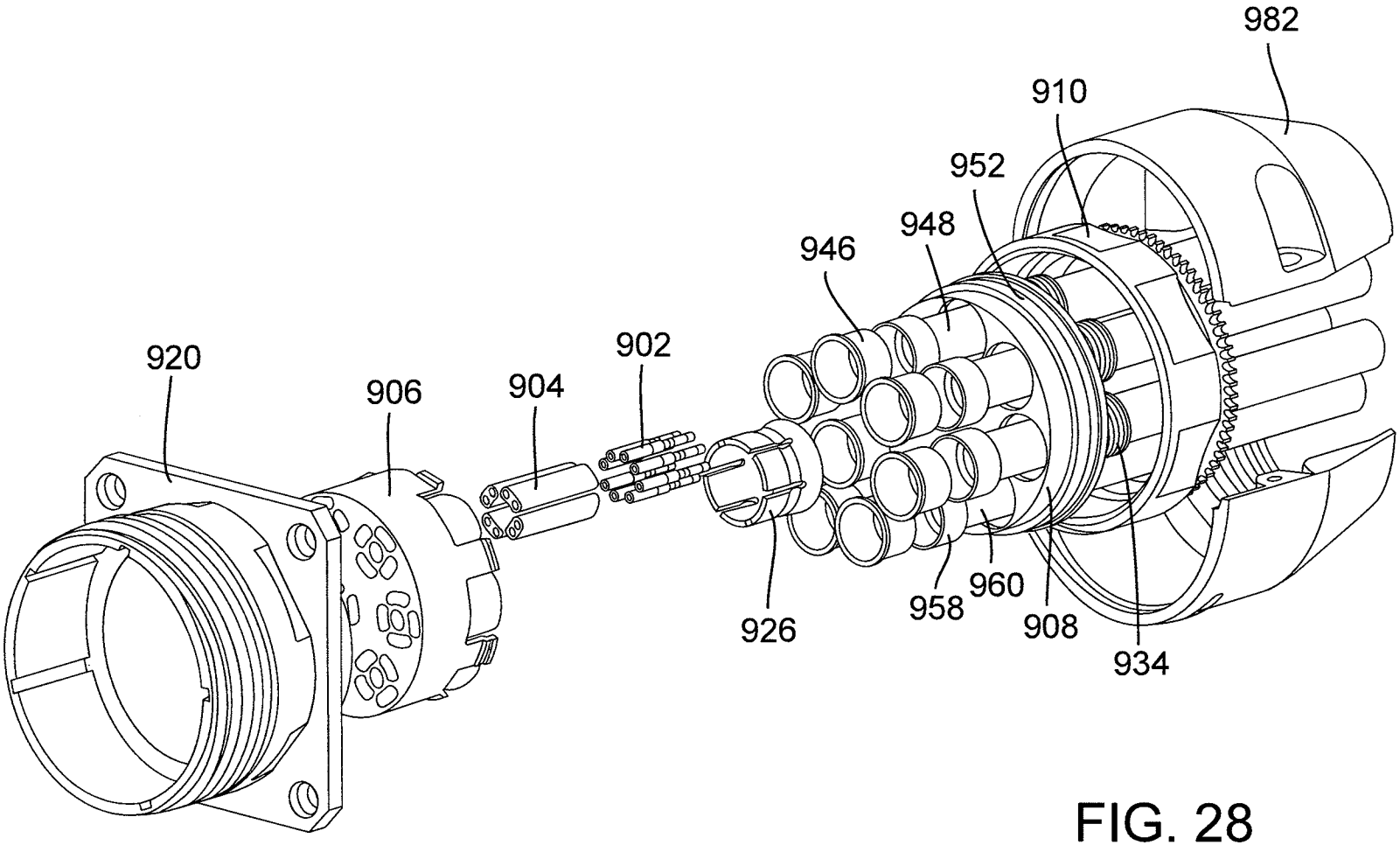
FIG. 28 is an exploded view of an electrical connector according to another embodiment.

FIGS. 28-31 collective illustrate another embodiment of an electrical connector 900, which in some embodiments may be a high-density MIL-DTL-38999 size 25 connector capable of housing 32 sheaths (and 64 total electrical contacts). FIG. 28 illustrates an exploded view of the electrical connector 900. In some embodiments, electrical connector 900 includes many similar components as the electrical connector 500 (described previously) with some modifications to accommodate additional sheaths, contacts, and other components of the larger electrical connector 900. For example, with particular reference to FIG. 28, the electrical connector 900 includes a plurality of electrical contacts 902, insulating sheaths 904, a plug insert 906, a shield housing 908, and a coupling nut 910, each preferably having substantially similar features arranged in a similar fashion as the corresponding components (with the same component name) of the electrical connector 500 (with some modifications as mentioned previously). Accordingly, to avoid repetition, details relating to these components of the electrical connector 900 may not be further described, except where appropriate to highlight certain features of the electrical connector 900 that may be different or operate differently from the electrical connector 500.

Figure 29:
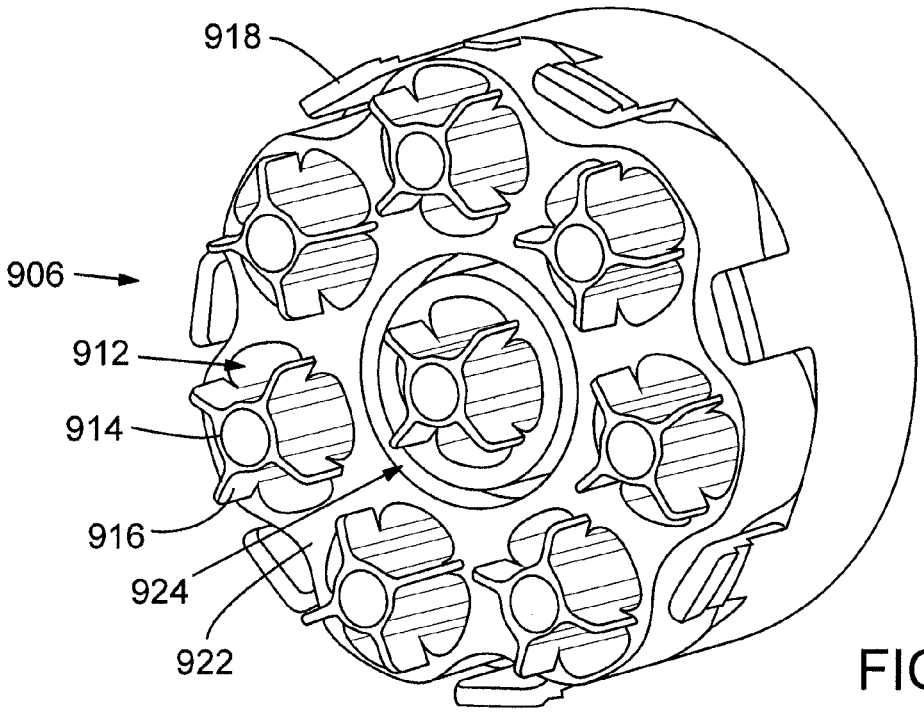
FIG. 29 is a perspective view of a plug insert of the electrical connector of FIG. 28.

With particular reference to FIG. 29, the electrical connector 900 includes a plug insert 906 that is generally similar to the plug insert 506 of the electrical connector 500. For instance, plug insert 906 includes a plurality of cavities 912 each sized for receiving sheaths 904. The cavities 912 may be arranged in distinct groups of four cavities each, where the individual cavities 912 in a group are separated by a central core 914 and radiating fins 916 in a similar fashion as described with respect to plug insert 506. In addition, plug insert 906 includes tangs 918 for snapping the plug insert 906 into position within a shell 920, which is preferably a MIL-DTL-39999 size 25 connector shell, in a similar fashion as described previously with reference to electrical connector 500.

As illustrated in FIG. 29, plug insert 906 may be capable of accommodating eight groups of cavities 912, generally arranged in a circular pattern on a rear face 922 of the plug insert 906. The plug insert 906 may include one group substantially centered on the rear face 922 and the remaining cavities 912 surrounding the central cavity. One primary difference between the plug insert 906 and the plug insert 506 is that around one of the cavities 912 (preferably the central cavity) of plug insert 906, the rear face 922 includes a slot 924 recessed inwardly into the plug insert 906 and encircling the cavity 912, where the recessed slot 924 effectively separates the central cavity 912 from the remaining cavities 912. As described in further detail below with particular reference to the cross-section in FIG. 31, the slot 924 receives and retains a portion of a grounding contact 926 to provide a solid mechanical connection and maintain shielding (such as against external electromagnetic interference that may otherwise interfere with the cables terminated by the connector 900) at the mating junction between the plug insert 906 and shield housing 908 when the electrical connector 900 is assembled.

Figure 30:
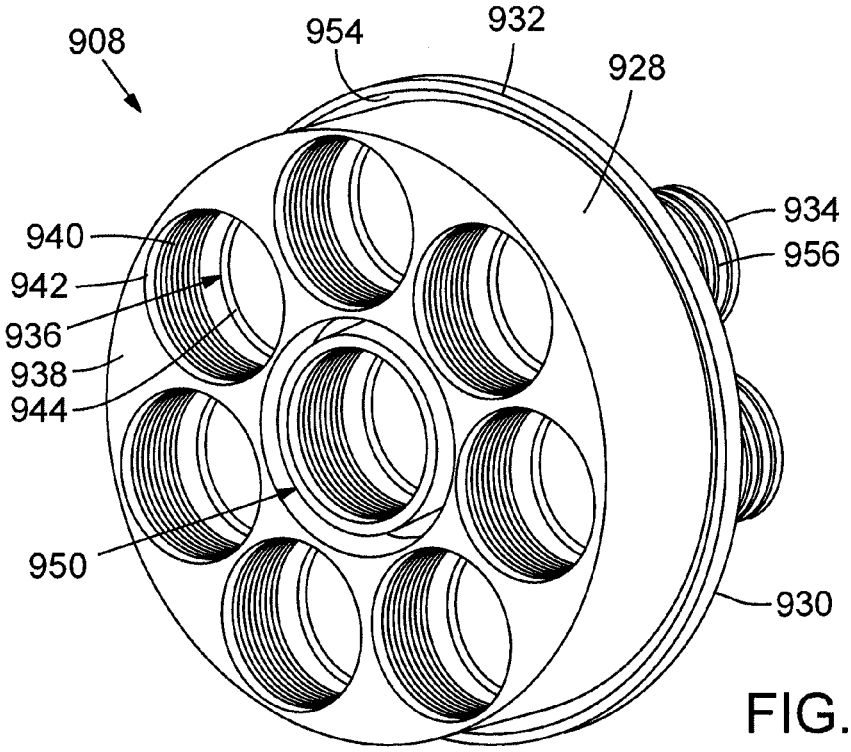
FIG. 30 is a perspective view of a shield housing of the electrical connector of FIG. 28.

Continuing to FIG. 30, the electrical connector 900 includes a shield housing 908 with similar features as the shield housing 506 described previously. For instance, the shield housing 908 includes a lower base 928, an upper head 930, and an annular lip 932 arranged in a similar configuration as described previously regarding shield housing 506. Similarly, the shield housing 908 further includes a plurality of barrels 934 projecting in an axial direction from a surface of the upper head 930. A cavity 936 extends entirely through the shield housing 908 (and each of the barrels 934) in the axial direction, the cavity 936 having an opening in a rear face 938 of the shield housing 908, and an opposite opening in a front face (not shown) of the shield housing 908. The cavities 936 accommodate cables/wires of the electrical connector 900.

With particular reference to FIG. 30, a plurality of circumferential grooves 940 are formed on each of the internal walls 942 associated with the cavities 936. In addition, the internal walls 942 include a shoulder 944 extending inwardly from the internal wall 942 toward a central axis of the cavity 936. As is further described in detail below, each of the cavities 936 receives and secures a shield ferrule 946 and a braid shield 948, with the shoulder 944 forming a seat for the shield ferrule 946 and braid shield 948, and the circumferential grooves 940 providing a biting engagement or mechanical grip to retain the braid shield 948 in position within the cavity 936.

Similar to the cavities 912 of the plug insert 906, the cavities 936 may be arranged in a circular pattern on the rear face 938 of the shield housing 908 so that each one of the cavities 936 are aligned with and overlap a corresponding group of cavities 912 on the plug insert 906 to provide a pathway for the cables/wires of the connector 900. Similar to the plug insert 906, the rear face 938 of the shield housing 908 includes a slot 950 recessed inwardly into the shield housing 908. The slot 950 encircles one of the cavities 936 (preferably the central cavity) of the shield housing 908, where the recessed slot 950 effectively separates the central cavity 936 from the remaining cavities 936. As is described further with particular reference to FIG. 31, the slot 950 retains a portion of the grounding contact 926 when the electrical connector 900 is assembled.

In some embodiments, the shield housing 908 may include a seal 952 retained in an internal channel 954 underneath the lip 932 (see FIG. 30). The seal 952 functions to hinder moisture, dust, or other contaminants from entering the electrical connector 900. As is further described in detail below, to help retain the seal 952 in position, the seal 952 may be compressed into the channel 954 by the plug insert 906 when the electrical connector 900 is assembled. In addition (or in an alternative embodiment), each of the barrels 934 includes a plurality of circumferential grooves 956 formed on the exterior surface. A moisture ingress resistant seal may be formed over the each of the barrels 934 by an adhesive-lined heat-shrink tube (not shown) that forms O-ring like seals in the grooves 956 when the adhesive melts and re-solidifies.

With general reference to FIGS. 28-31, the following section describes an example assembly operation of the electrical connector 900, according to one embodiment. It should be understood that the described assembly steps are for illustration purposes only and do not intend to delineate any particular order for assembling the electrical connector 900. With particular reference to FIG. 28, the sheaths 904 bearing the electrical contacts 902 are inserted into the cavities 912 of the plug insert 906 in a similar fashion as described with respect to electrical connector 500. It is noted that FIG. 28 only shows one group of four sheaths 904 and one group of eight electrical contacts 902 to avoid obscuring other aspects of the electrical connector 900. When assembled, each cavity 912 in the plug insert 906 will house a sheath 904 with electrical contacts 902.

Thereafter, a braid shield 948 is inserted through each of the cavities 936 of the shield housing 908 to protect and shield the cables/wires (not shown) of the electrical connector 900. In other embodiments, other types of shielding may be used, such as foil shielding, or a combination of foil and braid shielding. With particular reference to FIG. 28, the braid shield 948 includes a head 958 and a substantially tubular body 960 extending therefrom. The body 960 of the braid shield 948 is first inserted into the cavity 936, and the head 958 is urged into the cavity 936 until a bottom surface (not shown) of the head 958 rests against the shoulder 944 (see FIG. 30) within the cavity 936. Preferably, the cavity 936 is dimensioned relative to the head 958 so that there is a slight interference fit (e.g., 0.001-0.002 inches) when the braid shield 948 is inserted. The circumferential grooves 940 of the internal wall 942 maintain the braid shield 948 in position within the cavity 936 by providing a biting engagement or mechanical grip to help resist axial movement of the braid shield 948 out of the cavity 936. As illustrated in FIG. 28, the body 960 of the braid shield 948 extends through the cavity 936 and out the rear end of the barrel 934.

In some embodiments, as mentioned previously, the barrels 934 may further include heat-shrink material adhered to the grooves 956 and the braid shield 948 to form a moisture ingress resistant seal over the barrels 934 and braid shield 948. In addition, the braid shields 948 may each include solder sleeves (not shown) to improve shielding and attach a grounding wire or lead to the braid shield 948. Lacing ties may also be used to bundle together the various braid shields 948 and avoid potentially choking individual cables or creating bottlenecks or other issues that may affect overall performance.

After the braid shield 948 is in position, a shield ferrule 946 is inserted into the cavity 936 and the braid shield 948. The shield ferrule 946 has a generally tubular body 962 and an upper rim 964. When inserted, the body 962 rests inside the head 958 of the braid shield 948 and essentially acts like a cap on the braid shield 948. Preferably, the shield ferrule 946 is press fit into the cavity 936 and securely maintains the braid shield 948 in position. When the shield ferrule 946 is fully inserted, the upper rim 964 rests against the rear face 938 of the shield housing 908 to help lock the shield ferrule 946 in position. This process is repeated until braid shields 948 and shield ferrules 946 have been inserted into each cavity 936.

Figure 31:
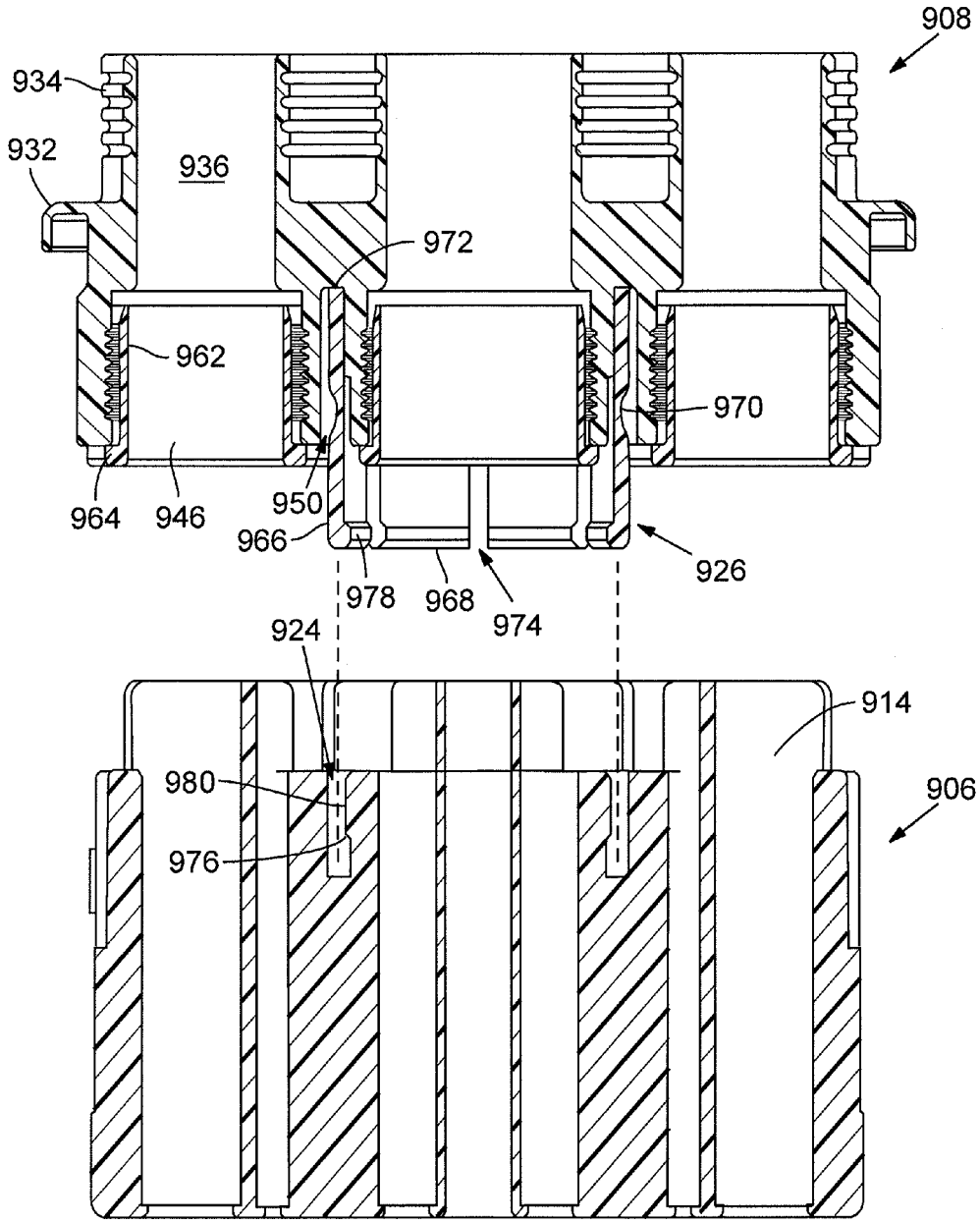
FIG. 31 is a partially exploded, cross-sectional view of the shield housing and plug insert of the electrical connector of FIG. 28, with certain components not shown for clarity.

After all the sheaths 904 have been inserted into the plug insert 906 and the shield ferrules 946 and braid shields 948 have been inserted into the shield housing 908, an electrically conductive, annular grounding contact 926 is positioned in the slots 924, 950 (see FIGS. 29 and 30) to mechanically connect the plug insert 906 and shield housing 908 together. With particular reference to FIGS. 28 and 31, the grounding contact 926 includes a plurality of cantilevered beams 966 formed on a back end 968, and a waist portion 970 positioned between the back end 968 and an opposite front end 972. The waist portion 970 preferably has a smaller outer diameter than each of the ends 968, 972. In some embodiments, longitudinal slots 974 formed on the grounding contact 926 may create the cantilevered beams 966 and provide sufficient clearance for flexing the rear end 968 of the grounding contact 926 as is further described in detail with reference to FIG. 31.

Turning to FIG. 31, when the electrical connector 900 is assembled, the front end 972 of the grounding contact 926 is inserted into the slot 950 of the shield housing 908 until the front end 972 contacts an end of the slot 950. In this position, the waist portion of the 970 of the grounding contact 926 is positioned in the slot 950, with only a portion of the cantilever beams 966 extending outwardly from the slot 950. Preferably, the slot 950 has a larger width as compared to the wall thickness of the grounding contact 926 to accommodate flexure of the walls as described below. Once the grounding contact 926 has been inserted into the slot 950, the shield housing 908 is brought together with the plug insert 906, with the cantilever beams 966 sliding into the slot 924 of the plug insert 906. The slot 924 includes a corresponding catch or shoulder 976 near an end of the slot 924. As the cantilever beams 966 slide into the slot 924, a catch 978 on a free end of the cantilever beams 966 contacts an internal wall 980 and slides against the wall 980 until reaching the catch/shoulder 976, at which point the catch 978 engages the shoulder 976 to latch the grounding contact 926. In this configuration, the grounding contact 926 maintains a solid mechanical connection and enhanced shielding at the mating junction between the plug insert 906 and shield housing 908. The interaction between the catch 978 and the shoulder 976 help prevent the components from being pulling apart.

It should be understood that in an alternative embodiment, the location of certain components may be rearranged as desired. For instance, in one embodiment, the catch/shoulder 976 may instead be positioned in the slot 950 of the shield housing 908. In such embodiments, the grounding contact 926 latches onto the shield housing 908 instead of latching onto the plug insert 906 as described previously. For instance, the front end 972 of the grounding contact 926 may be first inserted into the slot 924 of the plug insert 906, and the cantilevered beams 966 may latch onto the catch/shoulder 976 in the shield housing 908 in a similar fashion as described previously.

In yet another embodiment, both the recessed slots 924, 950 may include a catch/shoulder (such as catch 976), and the grounding contact 926 may further include a corresponding catch (not shown) similar to catch 978 on its front end 972, such that the front end 972 of the grounding contact 926 latches in place when inserted into one of the slots 924, 950. By providing catches on either end of the grounding contact 926, such design may provide a more secure retention mechanism for retaining the grounding contact 926 in position between the plug insert 906 and the shield housing 908.

Once the plug insert 906 and shield housing 908 are latched together, the components may be inserted into the front shell 920 and secured via the tangs 918 in a similar fashion as described previously with respect to the electrical connector 500. The remaining components, including the coupling nut 910 and the rear shell 982 may be assembled in a similar fashion as the like components described previously with respect to the electrical connector 500. In an alternate assembly operation, the plug insert 906 may first be inserted into the front shell 920 and latched thereto via the tangs 918, and the sheaths 902 may thereafter be inserted into the cavities 912. Once the components of the shield housing 908 have been assembled as described previously, then the grounding contact 926 may be inserted into the slot 950 and the shield housing 908 may be connected to the plug insert 906. The remaining components, including the coupling nut 910 and the rear shell 982 may thereafter be assembled as previously described.

In still another embodiment, the recessed slots 924, 950 may be larger than the illustrated example embodiment and encircle multiple cavities 912, 936 of the plug insert 906 and the shield housing 908, respectively. For example, in one embodiment, the slots 924, 950 may be formed on an outer portion of the plug insert 906 and the shield housing 908, respectively, such that the slots 924, 950 each surround all of the cavities 912, 936, respectively. In other embodiments, the slots 924, 950 may each instead surround a select subset of the cavities 912, 936 as desired. In still other embodiments, some or all of the cavities 912, 936 may each include individual slots (such as slots 924, 950). In such embodiments, the electrical connector 900 includes a plurality of grounding contacts 926, with each grounding contact 926 being received in a corresponding one of the slots in a similar fashion as described previously.

Preferably, plug insert 906, grounding contact 926, shield housing 908, coupling nut 910, and the front and rear shells 920, 982 596 are each made from an electrically conductive material, such as silver plated T6-7075 aluminum, for example. Other suitable materials, such as gold, nickel, aluminum alloys, steel, copper may also be used to coat or plate these components. In some embodiments, some or all of these components may be made from an insulating material, such as polyetherimide or other suitable engineering plastics, that is coated or plated with an electrically conductive material, such as silver, gold, or nickel. In a preferred embodiment, the plug insert 906, grounding contact 926, shield housing 908, and coupling nut 910 are each machined or otherwise manufactured (e.g. molded, injection molded, casted, etc.) as single, monolithic structures.

It should be understood that while a mating connector is not specifically illustrated or described for electrical connector 900, the mating connector may include the same or substantially similar components as the electrical connector 900, but the electrical contacts 902 (shown as socket contacts in FIG. 28) of the mating connector may be pin contacts so that the connectors can be mated. In addition, it should be understood that the particular front and rear shells 920, 982 illustrated in FIG. 28 are meant to illustrate one example embodiment of an electrical connector. In other embodiments, the shells may be different to accommodate various connector types, such as PCB or other connector systems.

Other embodiments are possible. Although the description above contains much specificity, these details should not be construed as limiting the scope of the invention, but as merely providing illustrations of some embodiments of the invention. It should be understood that subject matter disclosed in one portion herein can be combined with the subject matter of one or more of other portions herein as long as such combinations are not mutually exclusive or inoperable.

The terms and descriptions used above are set forth by way of illustration only and are not meant as limitations. It will be obvious to those having skill in the art that many changes may be made to the details of the above-described embodiments without departing from the underlying principles of the invention.

The invention claimed is:

1. An electrical connector, comprising:

an electrically conductive plug insert having a plurality of contact-receiving cavities extending in an axial direction through the plug insert, each of the cavities having a first opening at a first face and a second opening at a second face of the plug insert opposite the first face, the first face further including a first recessed slot and a first stop wall formed at an interior end of the first recessed slot;

a plurality of electrically insulating sheaths, each sheath carrying a pair of electrical contacts in a spaced-apart relation such that each electrical contact is in alignment with one of a pair of contact apertures in a wall of the sheath, each sheath sized for insertion into one of the contact-receiving cavities of the plug insert;

a plurality of electrically conductive shield ferrules each having a front end and an opposite rear end;

an electrically conductive shield housing having a first face and an opposite second face, the shield housing including a plurality of ferrule-receiving cavities extending in the axial direction from the first face of the shield housing toward the second face, wherein each of the plurality of electrically conductive shield ferrules is received and retained in a corresponding ferrule-receiving cavity, the second face further including a second recessed slot and a second stop wall formed at an interior end of the second recessed slot;

a catch formed within either or both of the first recessed slot of the plug insert adjacent the first stop wall and the second recessed slot of the shield housing adjacent the second stop wall; and an electrically conductive grounding contact having a first end including a flexible skirt, and a second end opposite the first end, wherein the flexible skirt is received in one of the first recessed slot or the second recessed slot and the second end of the grounding contact is received in the other of the first or second recessed slot adjacent the first or second stop wall thereof the flexible skirt latching with the catch of the first or second recessed slot when the electrical connector is assembled.

2. The electrical connector of claim 1, wherein the flexible skirt of the grounding contact further includes cantilever members that flex radially inwardly to constrict the flexible skirt when the flexible skirt latches onto the catch.

3. The electrical connector of claim 1, wherein each of the cantilever members include a second catch on a free end thereof, the second catch latching with the catch of the first or second recessed slot when the electrical connector is assembled.

4. The electrical connector of claim 1, wherein the first recessed slot encircles one of the contact-receiving cavities of the plug insert, and wherein the second recessed slot encircles one of the ferrule-receiving cavities of the shield housing.

5. The electrical connector of claim 1, further comprising a plurality of cable shields, wherein each of the cable shields is seated in a corresponding one of the ferrule-receiving cavities, such that each ferule-receiving cavity includes one cable shield and one shield ferrule.

6. The electrical connector of claim 5, wherein each of the ferrule-receiving cavities includes a plurality of circumferential grooves formed therein, the grooves contacting a portion of the cable shield and providing a gripping surface to retain the cable shield in position.

7. The electrical connector of claim 6, wherein each of the shield ferrules includes an upper rim on the front end and a tubular body extending therefrom toward the rear end, the upper rim contacting the second face of the shield housing when the shield ferrule is inserted into the ferrule-receiving cavity.

8. The electrical connector of claim 7, wherein the shield ferrule is seated against and covers the braid shield within each of the ferrule-receiving cavities.

9. The electrical connector of claim 5, wherein the electrically conductive shield housing further includes a plurality of cylindrically-shaped barrels extending in the axial direction from the first face.

10. The electrical connector of claim 9, wherein each of the cable shields extends through the ferrule-receiving cavity and out of the barrel.

11. The electrical connector of claim 10, further comprising:

a plurality of circumferential grooves spaced along an exterior surface of each of the barrels; and an adhesive-lined heat-shrink tube adhered to the circumferential grooves and the cable shields.

12. The electrical connector of claim 1, wherein each of the contact-receiving cavities include a conductive central core extending in the axial direction and a plurality of conductive fins radiating outwardly from the core, each of the fins separating adjacent contact-receiving cavities from each other.

13. The electrical connector of claim 1, wherein the grounding contact is integrally formed as a single, monolithic structure.

14. The electrical connector of claim 1, the grounding contact further including a waist portion between the first and second ends, the waist portion having a smaller diameter than each of the first and second ends.

* * * * *